US007261147B2

(12) United States Patent
Oh et al.

(10) Patent No.: US 7,261,147 B2
(45) Date of Patent: Aug. 28, 2007

(54) HEAT EXCHANGER

(75) Inventors: Sai Kee Oh, Seoul (KR); Cheol Soo Ko, Goonpo-si (KR); Dong Yeon Jang, Siheung-si (KR); Yong Cheol Sa, Anyang-si (KR); Se Yoon Oh, Seoul (KR); Baik Young Chung, Incheon-si (KR)

(73) Assignee: LG Electronics Inc., Seoul (KR)

( * ) Notice: Subject to any disclaimer, the term of this patent is extended or adjusted under 35 U.S.C. 154(b) by 519 days.

(21) Appl. No.: 10/755,443

(22) Filed: Jan. 13, 2004

(65) Prior Publication Data

US 2004/0251016 A1 Dec. 16, 2004

(30) Foreign Application Priority Data

May 28, 2003 (KR) ..... 10-2003-0034102
Sep. 15, 2003 (KR) ..... 10-2003-0063681
Sep. 15, 2003 (KR) ..... 10-2003-0063682

(51) Int. Cl.
*F28F 1/30* (2006.01)

(52) U.S. Cl. ..... 165/151; 165/DIG. 504

(58) Field of Classification Search ..... 165/151, 165/182

See application file for complete search history.

(56) References Cited

U.S. PATENT DOCUMENTS 1,915,742 A 6/1933 Mautsch
3,645,330 A * 2/1972 Albright et al. ..... 165/151
3,796,258 A * 3/1974 Malhotra et al. ..... 165/151
4,300,629 A * 11/1981 Hatada et al. ..... 165/151
4,691,768 A * 9/1987 Obosu ..... 165/151
4,705,105 A 11/1987 Cur
4,923,002 A * 5/1990 Haussmann ..... 165/151
5,056,594 A 10/1991 Kraay
5,203,403 A 4/1993 Yokoyama et al.
5,207,270 A * 5/1993 Yokoyama et al. ..... 165/151
2005/0045316 A1* 3/2005 Oh et al. ..... 165/166
2005/0056407 A1* 3/2005 Oh et al. ..... 165/151

FOREIGN PATENT DOCUMENTS

CN 1051150 C 4/2000
EP 0 789 216 A2 8/1997
GB 448815 A 6/1936
JP 56023699 A * 3/1981
JP 61-159094 A 7/1986
JP 61153498 A * 7/1986
JP 01095294 A * 4/1989
JP 02029597 A * 1/1990
JP 2-275295 A 11/1990
JP 02275295 A * 11/1990
JP 04015492 A * 1/1992
JP 09-079695 3/1997
JP 10-300375 11/1998

* cited by examiner

*Primary Examiner*—Allen J. Flanigan
(74) *Attorney, Agent, or Firm*—Birch, Stewart, Kolasch & Birch, LLP

(57) ABSTRACT

Disclosed is a heat exchanger including a plurality of tubes through which refrigerants flow, the tubes being spaced away from each other, and a plurality of fins through which the tubes are perpendicularly inserted, the fins being spaced away from each other at a predetermined distance, each of the fin having more than four peak portions and more than four valley portions that are alternately disposed. Heights or depths of at least two peak portions or at least two valley portions being different from each other.

17 Claims, 22 Drawing Sheets

(a)

(b)

(a)

(b)

(a)

(b)

(a)

(b)

(a)

(b)

HEAT EXCHANGER

This Non-provisional application claims priority under 35 U.S.C. §119(a) on Patent Application No(s). 10-2003-0034102; 10-2003-0063681; and 10-2003-0063682 filed in Korea on May 28, 2003; Sep. 15, 2003; and Sep. 15, 2003, respectively, the entire contents of which are hereby incorporated by reference.

BACKGROUND OF THE INVENTION

1. Field of the Invention

The present invention relates to a heat exchanger, and more particularly, to a heat exchanger in which an inclined angle and an air flow varying element are structurally modified to effectively guide air flow along fins disposed between tubes up to rear ends of the tubes.

2. Description of the Related Art

Generally, a heat exchanger is installed in an air conditioner and functions as an evaporator or a condenser for performing a heat exchange between a refrigerant and air. A fin-tube type heat exchanger is widely used among various kinds of the heat exchanger.

In the fin-tube type heat exchanger, the fins installed in a tube for air flow are classified into a slit fin, a louver fin, and a corrugate fin that is formed in a W-shape.

FIG. 1 shows a conventional heat exchanger having the corrugate fin.

Referring to FIG. 1, a heat exchanger 1 includes a plurality of corrugate fins 10 spaced away from each other at a predetermined distance and formed in a W-shape, and a plurality of tubes 30 disposed penetrating the corrugate fins 10 at right angles and along which a refrigerant flows.

Here the fin 10 is provided with peak portions 12 and valley portions 14 at which the tubes are not penetrated and which are intersected with each other at a predetermined angle, a plurality of fin collars 16 defining tube insertion holes through which the tubes are inserted, and a plurality of seats 18 formed in a concentric circle shape to support the fin collars 16.

Herein, the conventional heat exchanger having the corrugate fin will be described with reference to FIGS. 1 to 4.

Referring to FIG. 1, the heat exchanger 1 is a fin-tube type, and a plurality of fins 10 and a plurality of tubes are intersected with each other in a perpendicular direction. The tubes 30 arranged in two rows penetrate the plurality of fins 10 in a perpendicular direction.

Each of the fins 10 is the corrugate fin (hereinafter, abbreviated a fin). Each of the fins 10 has a plurality of donut-shaped flat portions and a plurality of inclined portions that are defined by the W-shape having a plurality of the peak and valley portions. The fins 10 are installed on the tubes 30 in a longitudinal direction of the tubes 30, being spaced away from each other at a predetermined distance.

Referring to FIGS. 2 and 3, there is shown a detailed structure of the fin 10. The fin 10 is formed in a W-shape with the peak and valley portions 12 and 14 that are alternately formed. That is, the fin 10 has two side ends that are respectively defined by the valley portions 14*a* and 14*c*. In case a plurality of fins 10 are used, the tubes 30 are arranged in two rows in a zigzag-shape in order to improve a heat exchange efficiency.

That is, each of the fins 10 installed on the tube 30 has two peak portions 12*a* and 12*b* and three valley portions 14*a*, 14*b* and 14*c*, which are alternately disposed and connected by inclined surfaces. The shape of the fin 10 is symmetrical based on the longitudinal valley portion 14*b*. Central axes of the zigzag-shaped tube 30 pass through the longitudinal center valley portion 14*b*.

The fin 10 is provided with a plurality of tube insertion holes 16*a*, central axes of which correspond to the respective central axes of the zigzag-shaped tube 30. The fin collars 16 are elevated from the fin 10 to define the tube insertion holes 16*a* through which the zigzag-shaped tube 30 is inserted. The tube 30 surface-contacts an inner circumference of each collars 16.

The seat 18 is formed in a concentric circle shape around a lower end of an outer circumference of the fin collar 16 to support the fin collar 16 and to allow air to flow in the form of enclosing the tube 30 and the fin collar 16.

An inclined portion 20 is formed on the fin 20 around the seat 18 to prevent the air flowing around the tube 30 from getting out of a circumference of the tube 30. The inclined portion 20 is inclined upward from the seat 18 to the adjacent peak portions 12.

The seat 18 is located on a horizontal level identical to that where the valley portions 14 are located. Heights and depths H1 and H2 of the peak and valley portions 12 and 14 are identical to each other. That is, the H1 indicates the heights of the adjacent peak portion 12 from the valley portions 14, and the H2 indicates the depths of the adjacent valley portion 14 from the peak portion 12. In addition, the inclined surfaces connecting the valley portions to the peak portions are inclined at an identical angle.

FIGS. 4(*a*) and 4(*b*) are respectively front and rear views of the fin, in which the peak portions 12 and valley portions 14 depicted in FIG. 4(*a*) correspond to the valley portions 14 and peak portions 12 depicted in FIG. 4(*b*), respectively.

When the air is introduced into the heat exchanger 1, the growth of a frost formed on an outer surface of the fin 10 is proportional to an amount of a heat transfer on the outer surface of the fin 10. At this point, the airflow speed is increased at the tube area as well as at the fin areas between the tubes 30 disposed in a longitudinal direction, thereby forming a high-speed airflow. As a result, the heat transfer coefficient is increased and the frost layer is quickly grown on the surface of the fin 10.

In case the frost layer is grown on the surface of the fin 10, since the distance between the adjacent fins 10 is reduced, an air passage area is also reduced. Due to the reduced area, the airflow speed is increased much more. As a result, the pressure drop of the air is increased in a parabola shape as time passes. Further, the heat transfer amount of the heat exchanger is also greatly reduced.

SUMMARY OF THE INVENTION

Accordingly, the present invention is directed to a heat exchanger that substantially obviates one or more problems due to limitations and disadvantages of the related art.

A first object of the present invention is to provide a heat exchanger that can improve the heat discharge efficiency compared with a conventional heat exchanger in which heights of peak and valley portions are identical to each other, in which heights of a corrugate fin formed between peak portions and valley portions on a left or right side of a reference line, through which central axes of the tube perpendicularly passes, become different from each other.

A second object of the present invention is to provide a heat exchanger including a fin bent in a zigzag-shape such that heights and depths of outer peak and valley portions are greater than those of inner peak and valley portions.

A third object of the present invention is to provide a heat exchanger including a fin bent in a zigzag-shape such that heights of outer peak portions are greater than those of inner peak portions to increase an air passage area, thereby increasing an amount of airflow.

A fourth object of the present invention is to provide a heat exchanger including a fin bent in a zigzag-shape such that widths of inclined portions connecting a center valley portion to adjacent peak portions are less than those of other inclined portions.

A fifth object of the present invention is to provide a heat exchanger having a fin bent in a zigzag shape with a center valley portion formed in a flat shape.

A sixth object of the present invention is to provide a heat exchanger including a fin bent in a zigzag shape such that depths of valley portions are less than heights of peak portions and an inclined portion is formed extending from a seat to the peak portions to allow air to effectively flow along tubes inserted in the fin.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided a heat exchanger comprising a plurality of tubes through which refrigerants flow, the tubes being spaced away from each other; and a plurality of fins through which the tubes are perpendicularly inserted, the fins being spaced away from each other at a predetermined distance, each of the fin having more than four peak portions and more than four valley portions that are alternately disposed, heights or depths of at least two peak portions or at least two valley portions being different from each other.

Each of the fins comprises a plurality of fin collars disposed along a longitudinal centerline of the fin, each of the fin collar being elevated to a predetermined height to define a tube insertion hole through which the tube is inserted; a plurality of seats each disposed on a lower end of an outer circumference of the fin collar; and an airflow guide portion formed extending from an outer circumference of the seat to the peak potions at a predetermined angle to allow air to flow along an outer circumference of the tube.

According to another aspect of the present invention, there is provided a heat exchanger comprising a plurality of tubes through which refrigerants flow, the tubes being spaced away from each other; and a plurality of fins spaced away from each other at a predetermined distance, each of the fin including a fin collar through which tube is perpendicularly inserted, a seat disposed around an outer circumference of the fin collar, and peak and valley portions alternately disposed, inclined angles of portions connecting the peaks with the valleys being different from each other.

According to still another aspect of the present invention, there is provided a heat exchanger comprising a plurality of tubes through which refrigerants flow, the tubes being spaced away from each other; and a plurality of fins spaced away from each other at a predetermined distance, each of the fin including a fin collar through which tube is perpendicularly inserted, a seat disposed around an outer circumference of the fin collar, and peak and valley portions alternately disposed, at least one of the valley portions being formed between the peak portions in a flat shape having a predetermined width.

According to still another aspect of the present invention, there is provided a heat exchanger comprising a plurality of tubes through which refrigerants flow, the tubes being spaced away from each other; and a plurality of fins spaced away from each other at a predetermined distance, each of the fin including a fin collar through which tube is perpendicularly inserted, a seat disposed around an outer circumference of the fin collar, peak and valley portions alternately disposed, inclined portions extending from an outer circumference of the seat to the peak portions.

It is to be understood that both the foregoing general description and the following detailed description of the present invention are exemplary and explanatory and are intended to provide further explanation of the present invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings:

FIG. 3(*b*) is a sectional view taken along the line B-B' of FIG. 2;

FIG. 4(*b*) is a rear view of a fin depicted in FIG. 2;

FIG. 8(*b*) is a rear view of a fin depicted in FIG. 6;

FIG. 15(*b*) is a rear view of a fin depicted in FIG. 13;

FIG. 21(*b*) is a sectional view taken along the line F-F' of FIG. 20;

FIG. 21(*c*) is a sectional view taken along the line G-G' of FIG. 20;

FIG. 22(*b*) is a rear view of a fin depicted in FIG. 20;

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

FIRST EMBODIMENT

FIGS. 5 to 12 show a first embodiment of the present invention.

Figure 1:
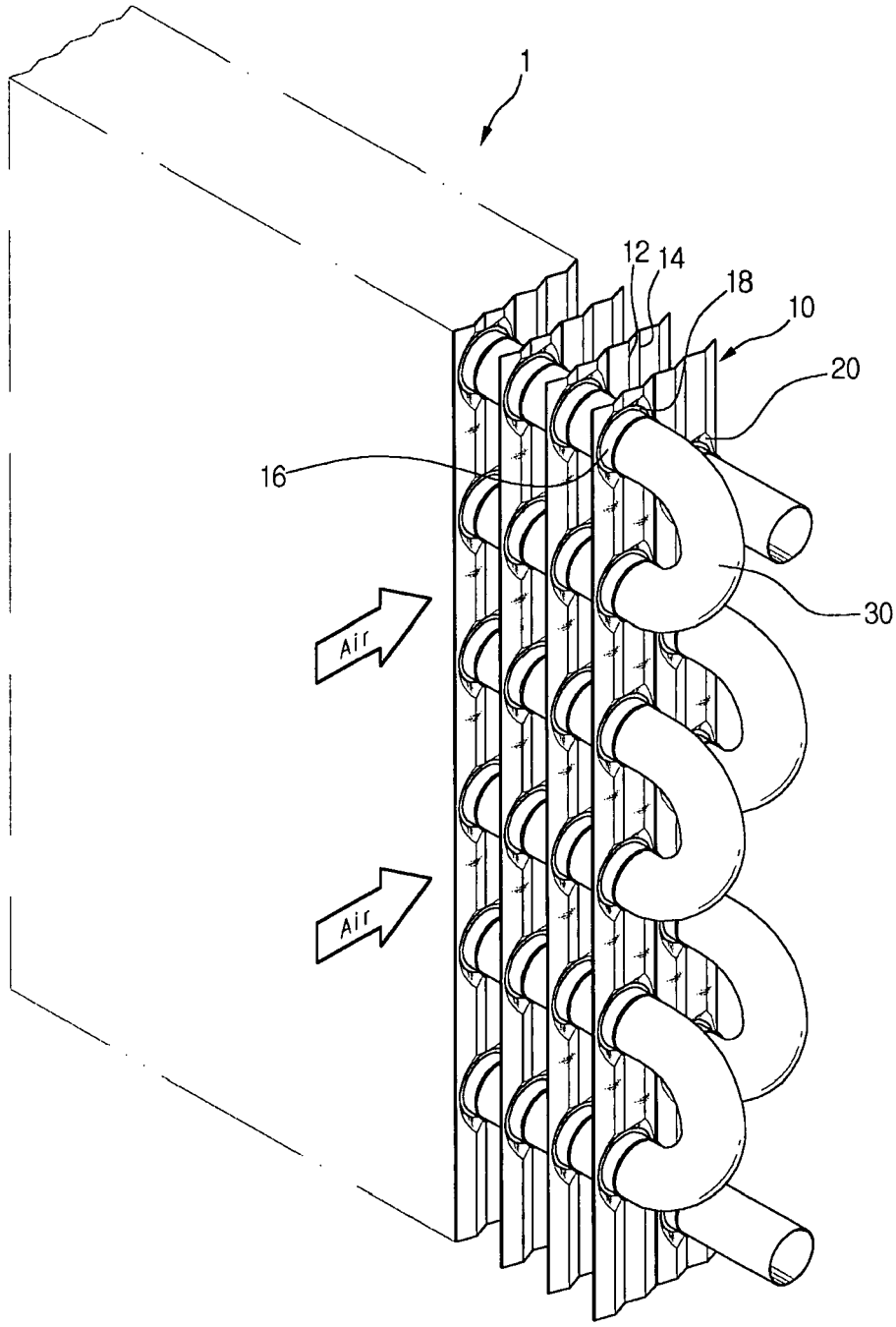
Fig.1 Related Art
FIG. 1 is a perspective view of a conventional heat exchanger.
Figure 2:
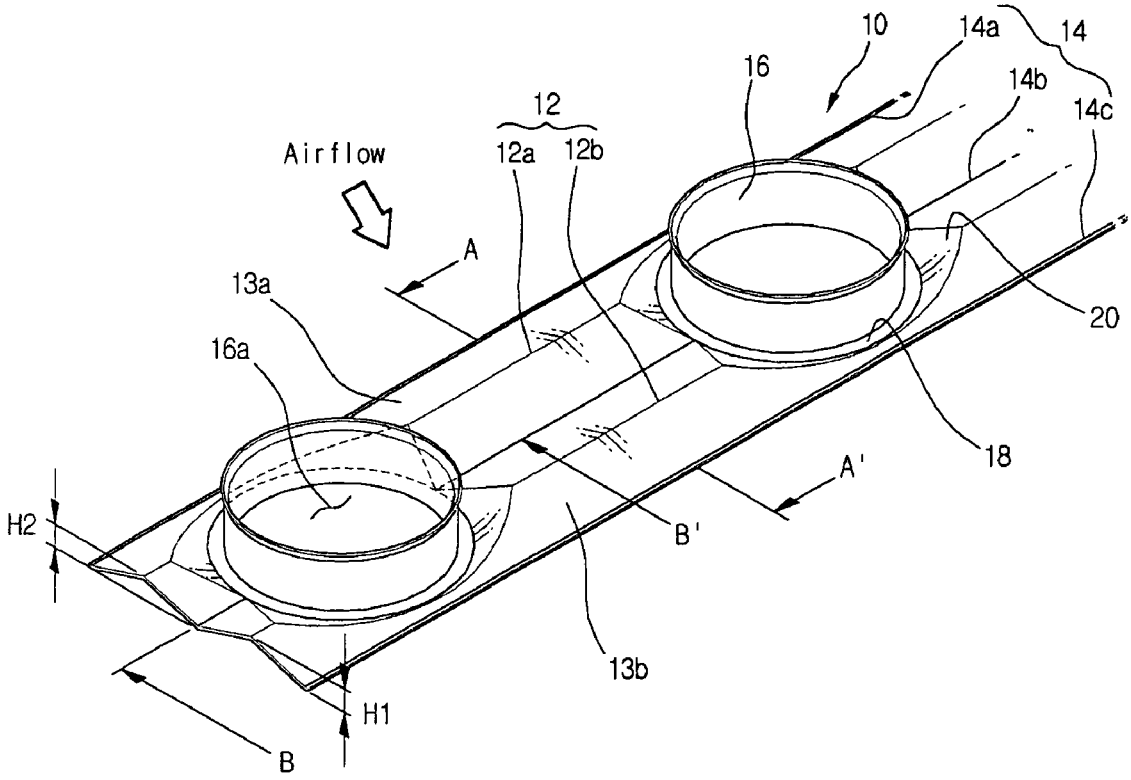
Fig.2 Related Art
FIG. 2 is a perspective view of a fin depicted in FIG. 1.
Figure 3:
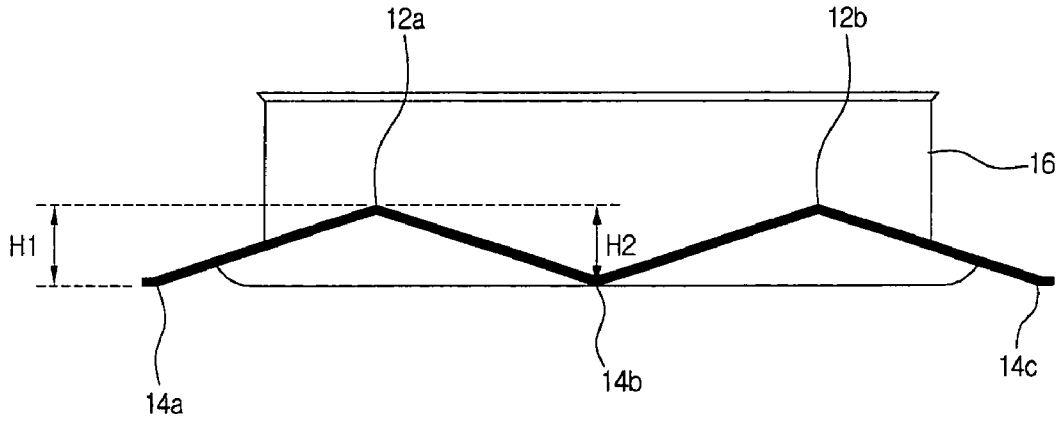
Fig.3 Related Art
FIG. 3(*a*) is a sectional view taken along the line A-A' of FIG. 2.
Figure 3:
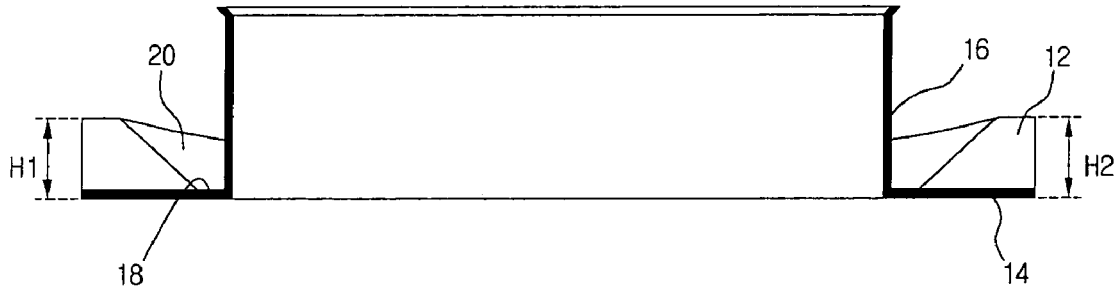
Fig.3 Related Art
Figure 4:
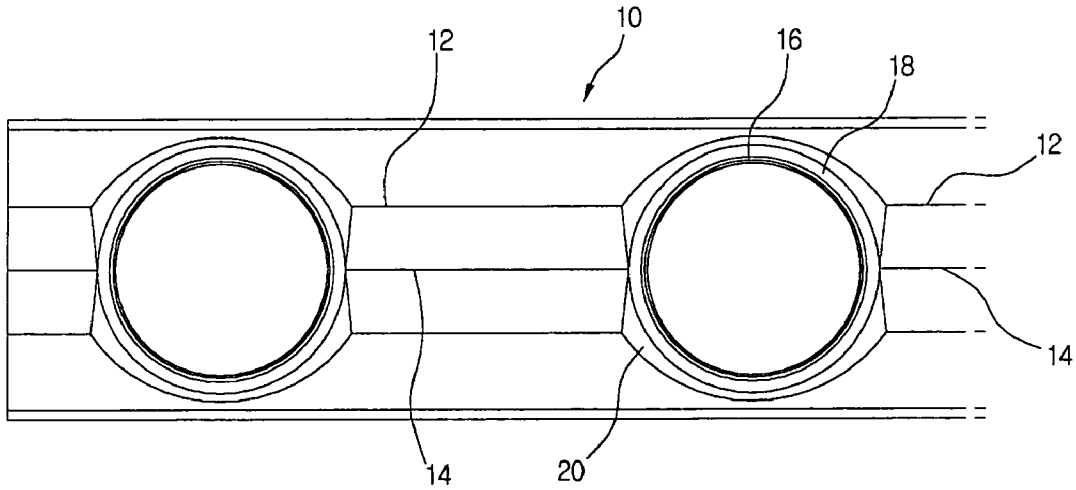
Fig.4 Related Art
FIG. 4(*a*) is a front view of a fin depicted in FIG. 2.
Figure 4:
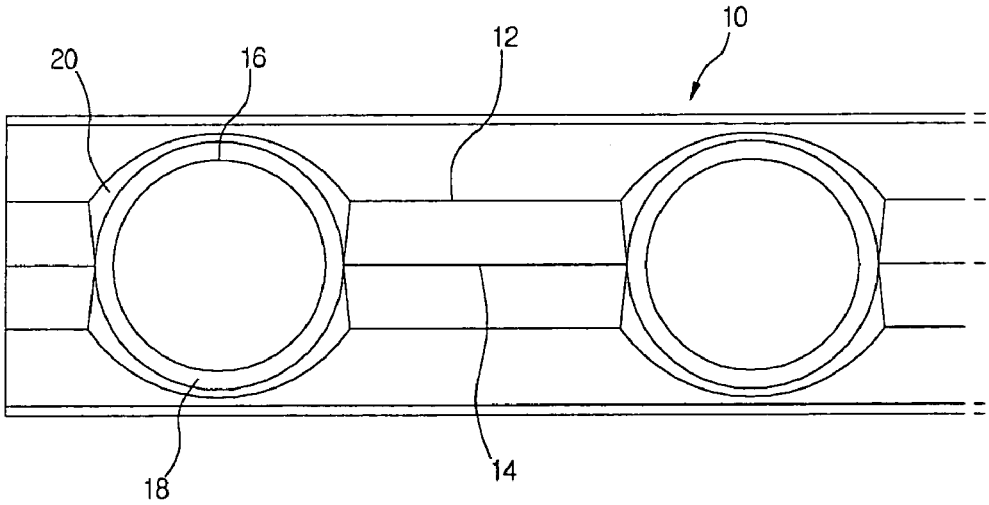
Fig.4 Related Art
Figure 5:
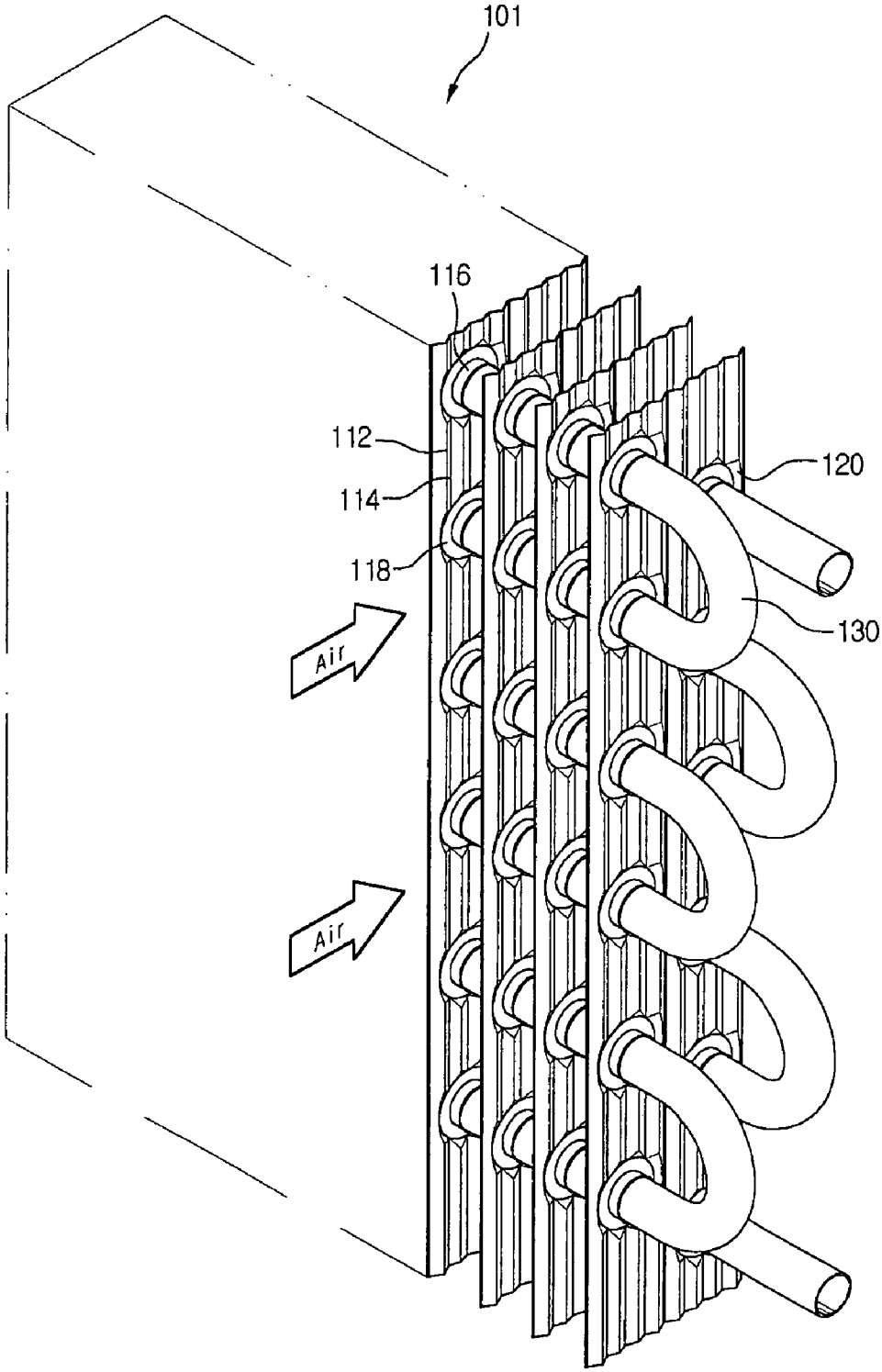
FIG. 5 is a perspective view of a heat exchanger according to a first embodiment of the present invention.
Figure 6:
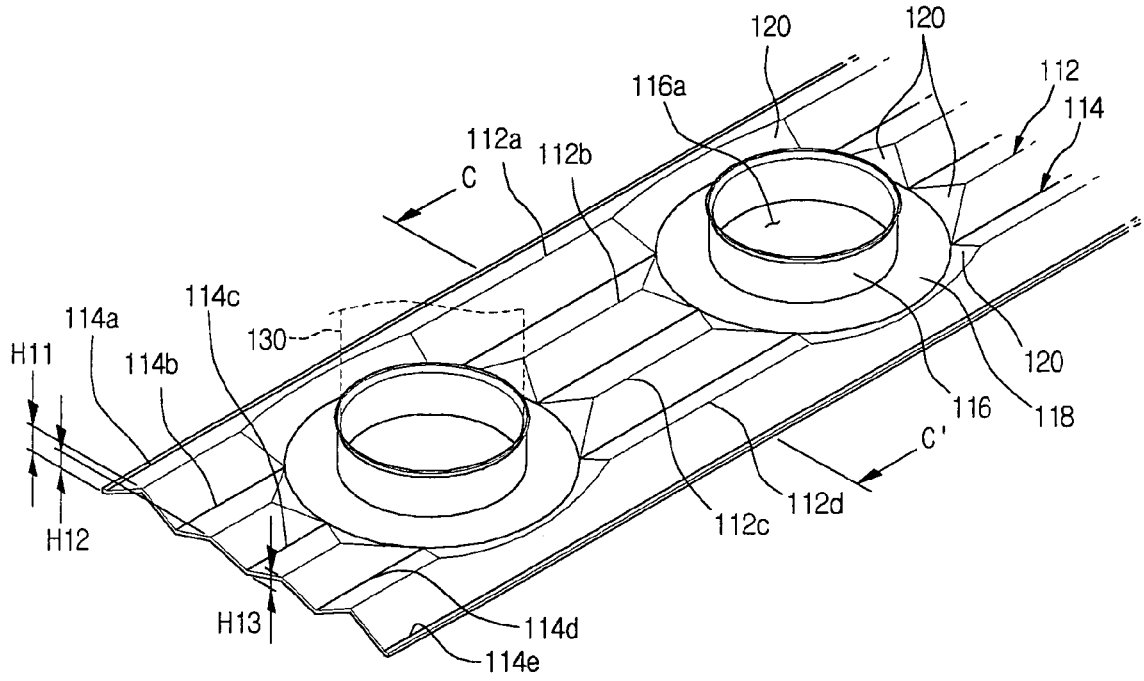
FIG. 6 is a perspective view of a fin depicted in FIG. 5.
Figure 7:
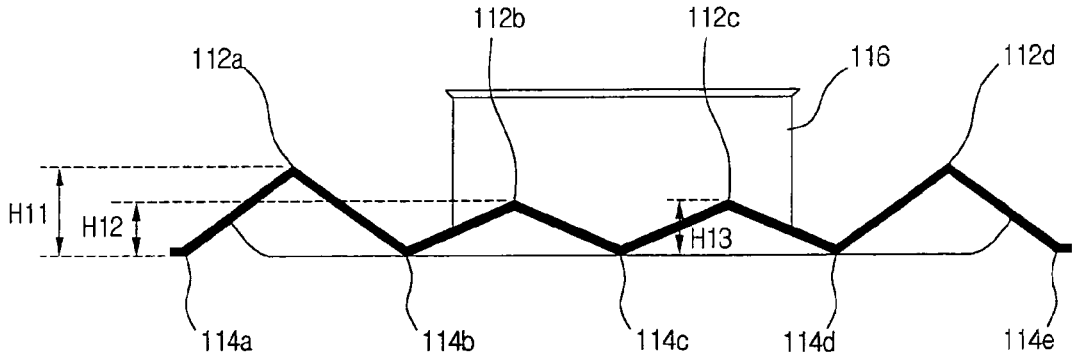
FIG. 7 is a sectional view taken along the line C-C' of FIG. 6.

Referring to FIGS. 5 to 7, the heat exchanger 101 according to the first embodiment of the present invention includes a plurality of fins 110 spaced away from each other at a predetermined distance and a plurality of tubes 130 disposed penetrating the fins 110 at right angles and along which a refrigerant flows.

Here, the fin 110 includes at least four peak portions 112 and at least five valley portions 114 formed inclined at a predetermined angle and continuously formed intersected with each other, fin collars 116 formed defining tube insertion holes 116*a* through which the tubes 130 perpendicularly pass, seats 118 for supporting the tubes 130, and inclined portions 120 inclined upwardly from outer circumferences of the seats 118 to the peak portions 112.

In the fin 110, at least four peak portions 112 (112*a*, 112*b*, 112*c* and 112*d*) and at least five valley portions 114 (114*a*, 114*b*, 114*c*, 114*d* and 114*e*) are alternately formed between the fin collars 116 and are connected to each other by surfaces inclined at a predetermined inclined angle.

As a feature of the present invention, the heights of the second and third peak portions 112*b* and 112*c* are lower than those of the first and fourth peak portions 112*a* and 112*d* to more effectively guide air flowing between the tubes up to rear ends of the tubes 30.

The operational effect of the heat exchanger according to the first embodiment of the present invention will be described hereinafter.

As shown in FIGS. 5 to 8, the heat exchanger 301 is a fin-tube type in which a plurality of corrugate fins each formed in a W-shape are perpendicularly disposed with respect to the tubes 130 and spaced away from each other at a predetermined distance.

Each of the fins 110 is divided into a fin collar area through which the tubes 130 penetrate and an inclined surface area defined between the fin collars 116. The heights and depths of the peak portions and valley portions are different from each other to let the flow of the air introduced into the heat exchanger changed.

That is, inclined angles of the inclined surfaces connecting the alternately disposed peak portions 112 (112*a*, 112*b*, 112*c* and 112*d*) and valley portions 114 (114*a*, 114*b*, 114*c* and 114*d*) are different from each other. For the more effective air incoming and outgoing operation, the fin 110 is configured to have both side ends defined by the first and fifth valley portions 114*a* and 114*e*. That is, the fin 110 starts with the valley portion 114*a* and ends with the valley portion 114*e* in a lateral direction.

In addition, the fin 110 is formed symmetrical based on the center valley portion 114*c*. That is, the left and right portions based on the central valley portion 114*c* are symmetrical, and the heights and depths of the peak portions and valley portions formed on each of the left and right portions are different from each other.

The valley portions 114*a*-114*e* are located on an identical horizontal plane, and the peak portions 112*a*-112*d* are located on a different horizontal plane.

The first valley portion 114*a* is defined by one side end of the fin, and the second valley portion 114*b* is located between the first and second peak portions 112*a* and 112*b*. The third valley portion 114*c* is located between the second and third peak portions 112*b* and 112*c*, and the fourth valley portion 114*d* is located between the third and fourth peak portions 112*c* and 112*d*. The fifth valley portion 114*e* is defined by the other side end of the fin.

At this point, the heights of the inner peak portions 112*b* and 112*c* are different from those of the outer peak portions 112*a* and 112*d*.

That is, as shown in FIGS. 6 and 7, the valley portions 113 are located on the identical horizontal plane, and the peak portions 112 are located in different heights H11, H12 and H13.

As shown in FIGS. 6 and 7, the valley portions are located on the identical horizontal plane, the left and right portions based on the center valley portion 114*c* are symmetrical, and the heights and depths of the peak portions and valley portions formed on each of the left and right portions are different from each other.

For example, the heights H12 and H13 from the horizontal plane where the valley portions 114 are located to the inner peak portions 112*b* and 112*c* are lower than the heights H11 from the horizontal plane to the outer peak portions 112*a* and 112*d*.

That is, the heights H11 of the first and fourth peak portions 112*a* and 112*d* are identical to each other, and the heights H12 and H13 of the inner peak portions 112*b* and 112*c* are also identical to each other but lower than those of the outer peak portions 112*a* and 112*d*. Here, the distance between the inner peak portions can be narrower than that between the outer peak portion and the adjacent inner peak portion.

By the above-described structure, the airflow of the air introduced into areas defined between the fins 110 is greatly varied when compared with the conventional art. Therefore, the air can be more effectively guided up to the rear ends of the tubes 30. In addition, the pressure drop is reduced for the high-speed airflow and an amount of the heat transfer is increased.

Specifically, when the heights H11 from the horizontal plane where the first valley portion 114*a* is located to the first and fourth peak portions 112*a* and 112*d* are identical to each other, the heights H12 and H13 from the horizontal plane where the second valley portion 114*b* is located to the second and third peak portions 112*b* and 112*c* are lower than the heights H11 of the first and fourth peak portions 112*a*.

Alternatively, the heights H12 and H13 are designed to be greater than the height H11, or the height H11 is designed to be greater than the height H12 while the height H12 is greater than the height H13.

The heights H12 and H13 of the peak portions 112*b* and 112*c* should not be higher than the heights H11 of the outermost peak portions 112*a* and 112*d*. For example, although the heights H11 of the first and fourth peak portions 112*a* and 112*d* are higher than the heights H12 and H13 of the second and third peak portions 112*b* and 112*c*, it is satisfied if only the respective heights are different from each other. Accordingly, the heat exchanger of the present invention reduces the pressure drop and increases the amount of heat transfer when compared with the conventional heat exchanger having a fin that is designed such that the heights H11, H12 and H13 are identical to each other.

Alternatively, the peak portions 112 may be located on an identical horizontal plane, and depths of the inner valley portions 114*b*, 114*c* and 114*d* may be lower than those of the outer valley portions 114*a* and 114*d*. In addition, among the depths of the inner valley portions 114*b*, 114*c* and 114*d*, the depth of the center valley portion 114*c* may be lower than other depths.

Alternatively, it is also possible that the heights from a reference horizontal plane to the peak portions are gradually reduced as they go toward a longitudinal center portion of the fin or the depths from a reference horizontal plane to the valley portions are gradually reduced as they go toward the longitudinal center portion of the fin.

Meanwhile, the fin collars 116 are formed on the fin 110 and are arranged in a longitudinal direction of the fin 110. All of the central axes perpendicularly meet the longitudinal center portion of the fin 110. The fin collars 116 define tube insertion holes 116*a* each having a diameter corresponding to an outer diameter of the tube to support the tube 130 inserted therein.

In addition, the seat 118 formed around a lower end of an outer circumference of the fin collar 116 has a predetermined width to support the fin collar 116. The seat 118 is disposed on a horizontal plane identical to that where the second, third and fourth valley portions 114*b*, 114*c* and 114*c* are located.

The inclined portions 120 are inclined upwardly from outer circumferences of the seat to the peak portions 112. That is, each of the inclined portions 120 is defined by connecting each of the peak portions 112*b* and 112*c* to the valley portions 114*b* and 114*c* or 114*c* and 114*d* contacting the outer circumference of the seat 118 and adjacent to the peak portions 112*b* and 112*c*, thereby being formed in a triangular-shape. The inclined portions 120 guide the air to flow along the outer circumference of the fin collars 116.

In addition, the inclined portions 120 may be further formed by connecting two points of each outer peak portion (the first and second peak portions 112*a* and 112*d*) to two points of each inner adjacent valley (the second and fourth valleys 114*b* and 114*d*) contacting the seat 118. In this case, the inclined portions 120 are formed in a rectangular shape. The inclined portions 120 function as a wall enclosing the fin collar 116.

Figure 8:
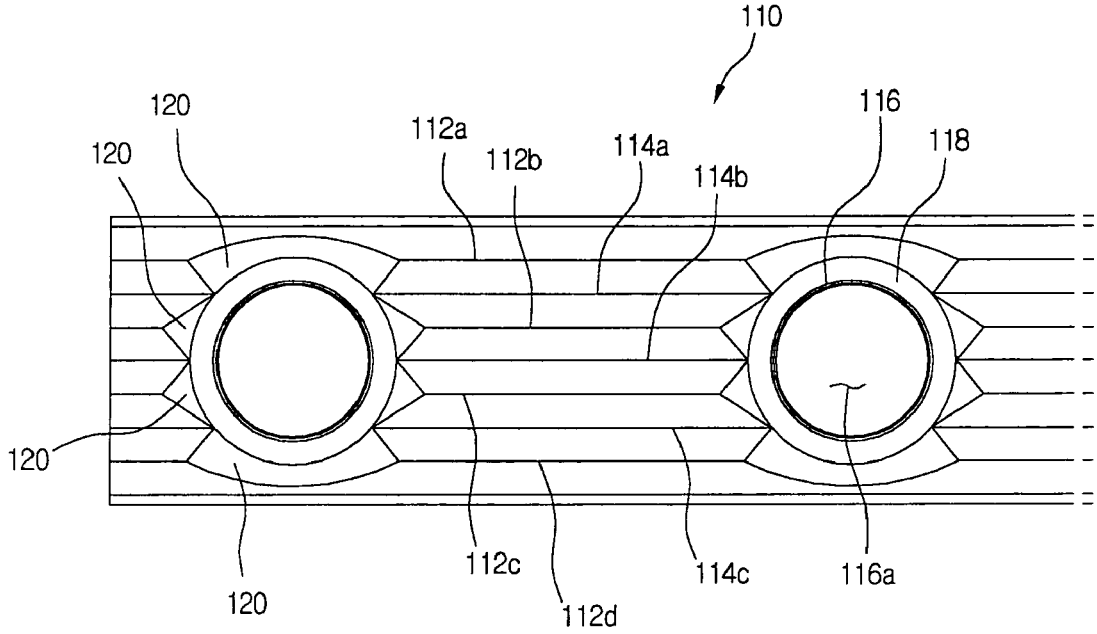
FIG. 8(*a*) is a front view of a fin depicted in FIG. 6.
Figure 8:
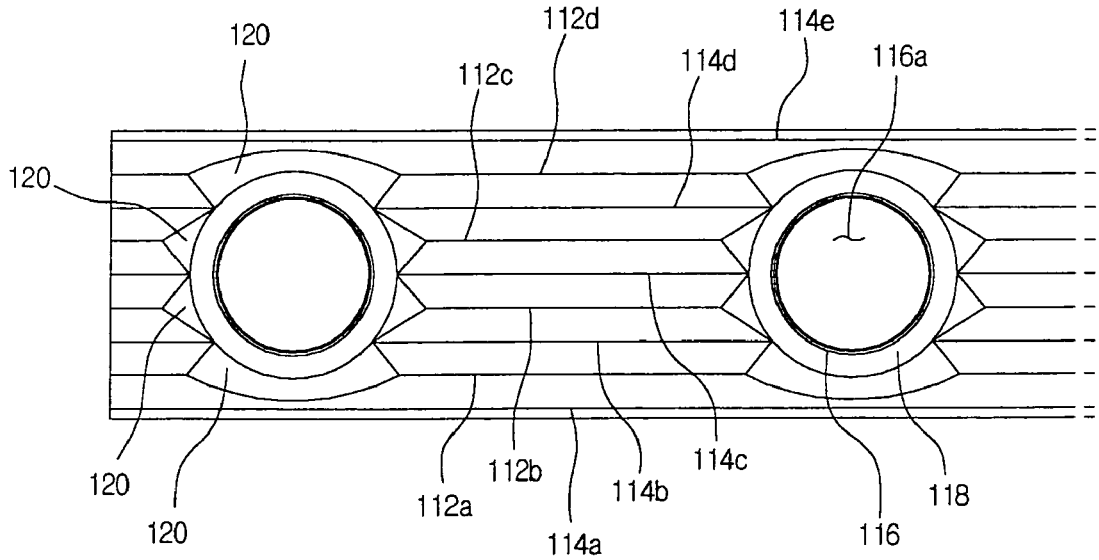

FIGS. 8(*a*) and 8(*b*) respectively show front and rear views of the fin according to the first embodiment of the present invention. The peak portions and the valley portions that are depicted in FIG. 8(*a*) become the valley portions and the peak portions in FIG. 8(*b*), respectively. That is, when being viewed in FIG. 8(*b*), the depths from the horizontal plane where the peak portions are located to the valley portions are different from each other.

Figure 9:
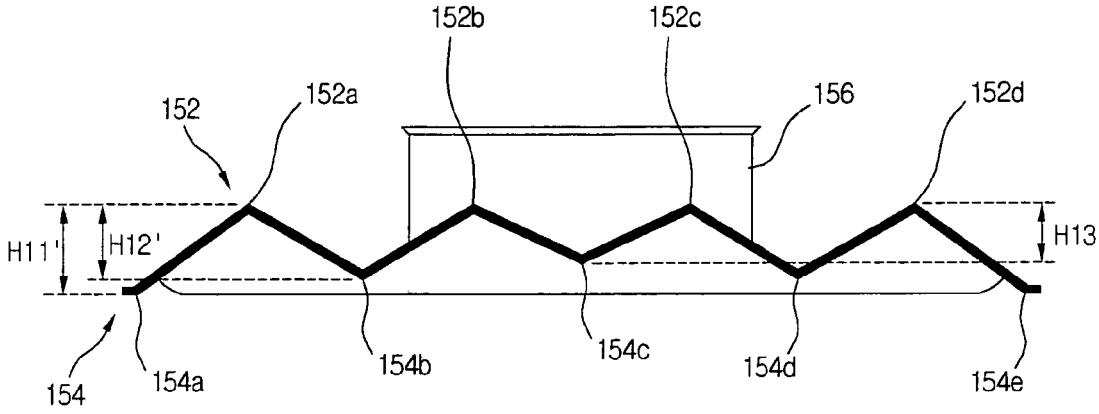
FIGS. 9 and 10 are views illustrating modified examples similar to that depicted in FIG. 7.

FIG. 9 shows a modified example of the first embodiment.

In this modified example, first, second, third and fourth peak portions 152 (152*a*, 152*b*, 152*c* and 152*d*) are located on an identical horizontal plane. The depths from the horizontal plane to valley portions 154 are gradually increased as they go from the center portion of the fin to both side ends of the fin. That is, the depths H12' of the second and fourth valley portions 154*b* and 154*d* are greater than that H13' of the third (center) valley portion 154*c*, and the depths H11' of the first and fifth valley portions 154*a* and 154*e* are greater than the depth H12'. In this modified example, a seat disposed around a lower end of an outer circumference of a fin collar 156 may be located on a horizontal plane different from horizontal planes where the valley portions are located.

Figure 10:
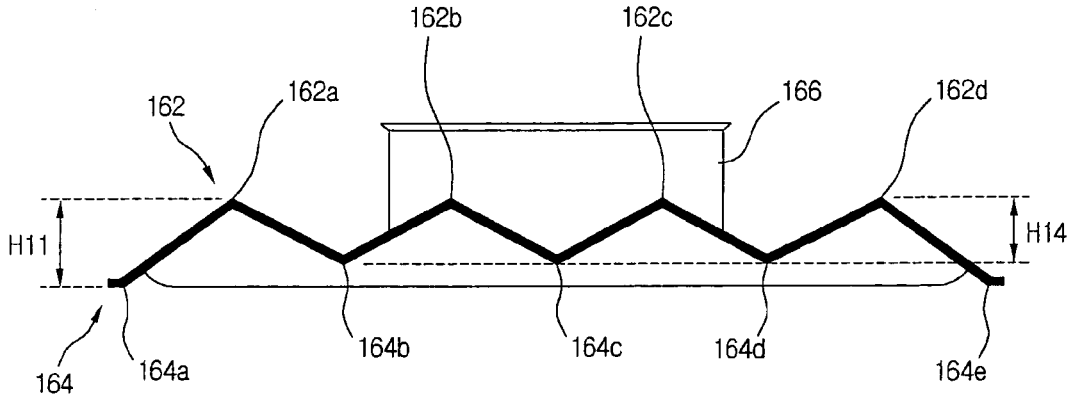

FIG. 10 shows another modified example of the first embodiment.

In this modified example, first, second, third and fourth peak portions 162 (162*a*, 162*b*, 162*c* and 162*d*) are located on an identical horizontal plane, depths H14 from the horizontal plane to inner valley portions 164*b*, 164*c* and 164*d* are identical to each other. In addition, depths H11 from the horizontal plane to outer valley portions are greater than the depth H14. In this modified example, a seat disposed around a lower end of an outer circumference of a fin collar 156 may be located on a horizontal plane different from horizontal planes where the valley portions are located.

In the above-described first embodiment, since the peak or valley portions are configured to have a different height or depth, a contacting area with the air is increased, increasing the airflow variation.

Although the fin is designed in a variety of structures, it is preferable that the heights or depths of the inner peak and valley portions are lower than those of the outer peak and valley portions.

Figure 11:
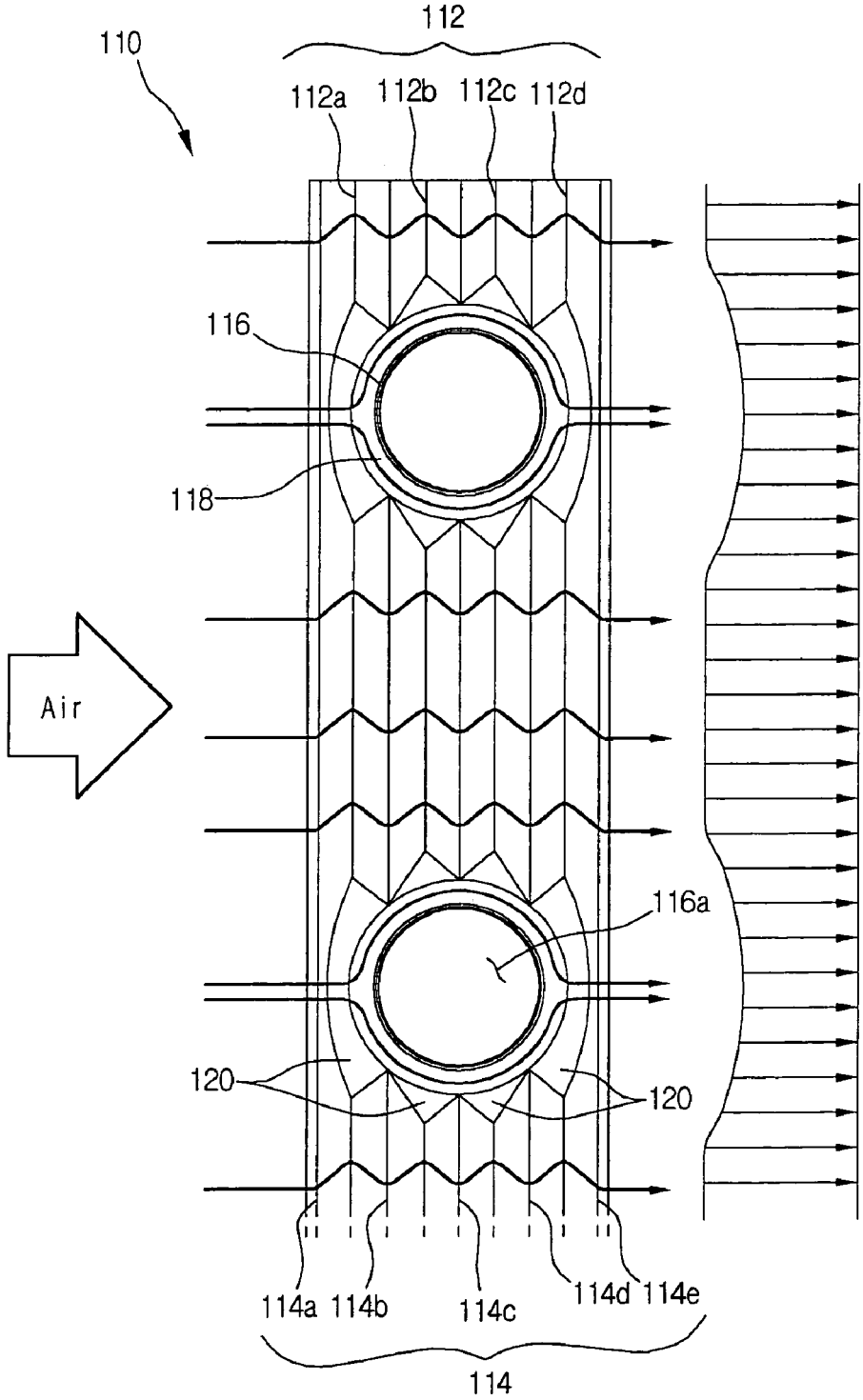
FIGS. 11 and 12 are views illustrating airflow states in a heat exchanger according to a first embodiment of the present invention.
Figure 12:
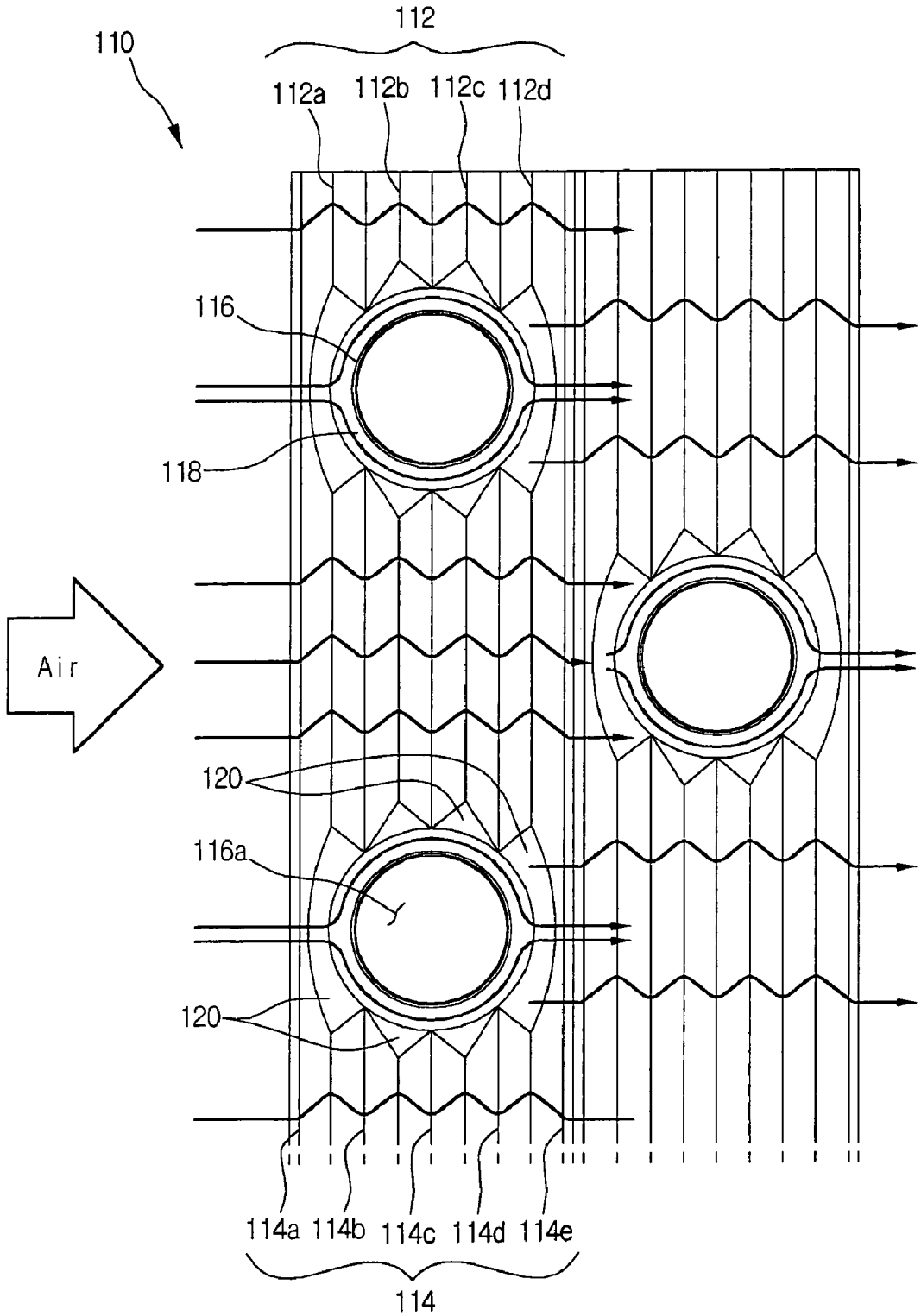

FIGS. 11 and 12 show an airflow state of the heat exchanger according to the first embodiment. FIG. 11 is a case where the fin is formed of a single fin structure, and FIG. 12 is a case where the fin is formed of a dual fin structure.

As shown in FIG. 11, when outer air is introduced into the heat exchanger, since the air quickly flows between the tubes while it repeatedly ascends and descends along the peak and valley portions 112 (112*a*, 112*b*, 112*c* and 112*d*) and 114 (114*a*, 114*b*, 114*c* and 114*d*), the contacting area between the air and the fins is increased.

That is, the air is introduced through the first peak portion 112*a*. The flow of the air introduced through the first peak portions 112*a* is varied as it further flows along the second and third peak portions 112*b* and 112*c*. As a result, the airflow speed is increased, thereby increasing the heat transfer efficiency.

Furthermore, since the heights H11 of the first and fourth peak portions 112*a* and 112*d* that are located on inlet and outlet sides of the air, respectively, are higher than those H12 and H13 of the second and third peak portions 112*b* and 112*c*, the distance between the adjacent fins 110 is increased to thereby increase the air passage area. As a result, the pressure drop is reduced for the high-speed airflow to thereby increase the amount of heat transfer and reduce the overall pressure drop of the heat exchanger.

In addition, since the fin collars, seats and inclined portions are formed around the tube insertion holes through which the tube is inserted, the air can be guided up to the rear end of the tube along the curvatures of the tube and the inclined portions.

Specifically, when the air passes between the tubes 130 at a high-speed, the high-speed airflow increases the heat transfer and retards the growth of the frost layer. Accordingly, a high level of heat capacity is maintained even under the frost forming condition, thereby increasing the heat exchange capability and making it possible to run the heat exchanger for many hours.

FIG. 12 shows an airflow state when the fins are formed in a dual fin structure and the tubes are perpendicularly installed on the fins in a zigzag-shape. Since the tubes are arranged in the zigzag-shape, when the air passes through a tube area and a none-tube area (area between the tubes), the airflow is realized as in the case where the fin is formed of a single fin plate.

In the above-described first embodiment, since the heights or depths of the inner peak and valley portions are lower than those of the outer peak and valley portions that are disposed on inlet and outlet sides of the air, the air can quickly flow between the tubes, the air can be effectively guided up to the rear end of the tube. In addition, since the pressure drop is reduced for the fast flow speed of the air flowing between the tubes while the heat transfer amount and heat exchange amount are increased, thereby improving the overall efficiency of the heat exchanger.

SECOND EMBODIMENT

FIGS. 13 to 18 show a second embodiment of the present invention.

Figure 13:
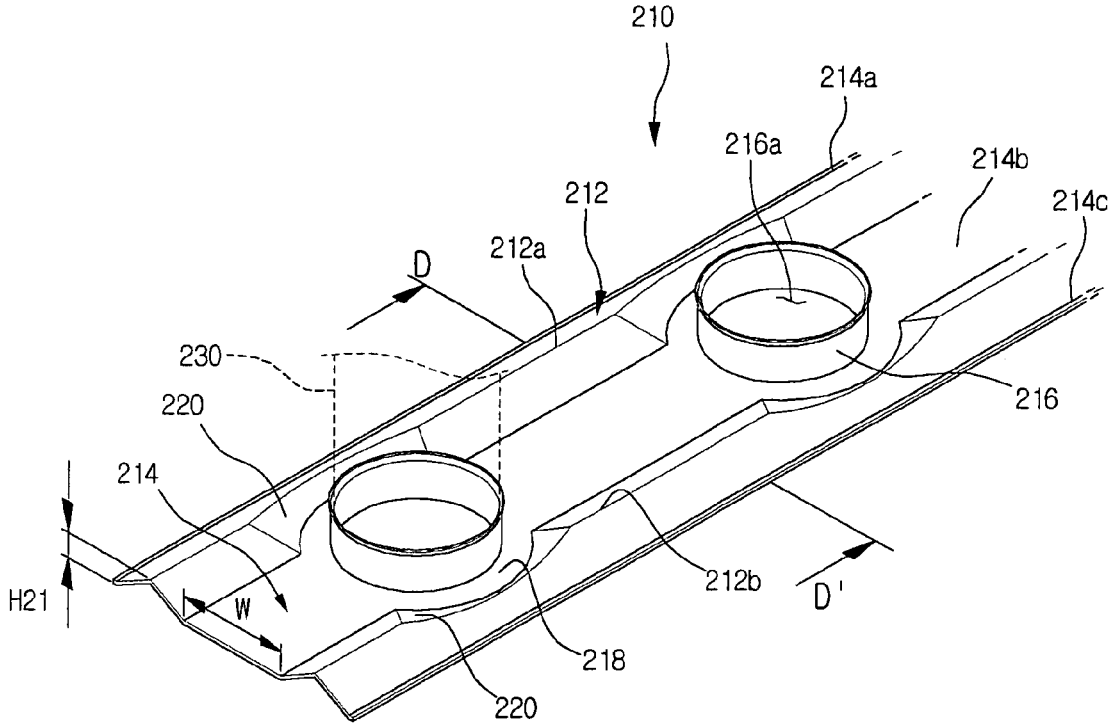
FIG. 13 is a perspective view of a fin of a heat exchanger according to a second embodiment of the present invention.

Referring to FIG. 13, a fin 210 includes first and second peak portions 212 (212*a* and 212*b*), first, second and third valley portions 214 (214*a*, 214*b*, and 214*c*). The first and third valley portions 214*a* and 214*c* are defined by both side ends of the fin, and the second valley portion 214*b* is formed between the peak portions 212*a* and 212*b*.

The first, second and third valley portions 214*a*, 214*b* and 214*c* are located on an identical horizontal plane. The second valley portion 214*b* has a predetermined width.

Figure 14:
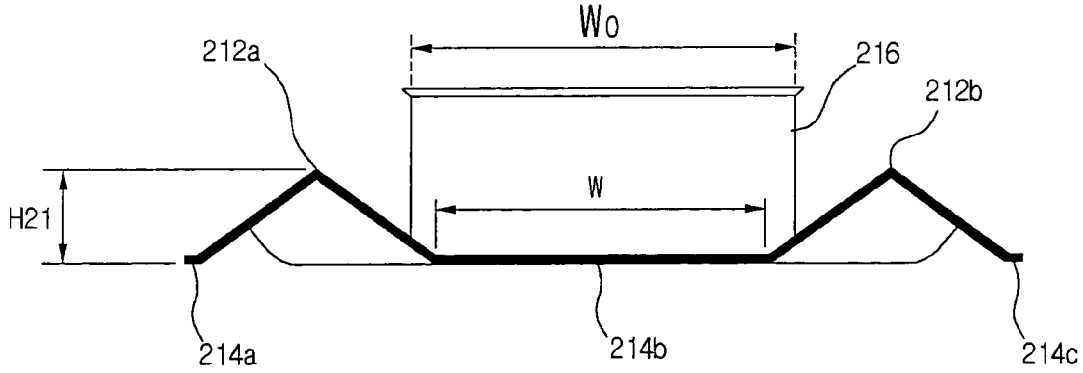
FIG. 14 is a sectional view taken along the line D-D' of FIG. 13.
Figure 15:
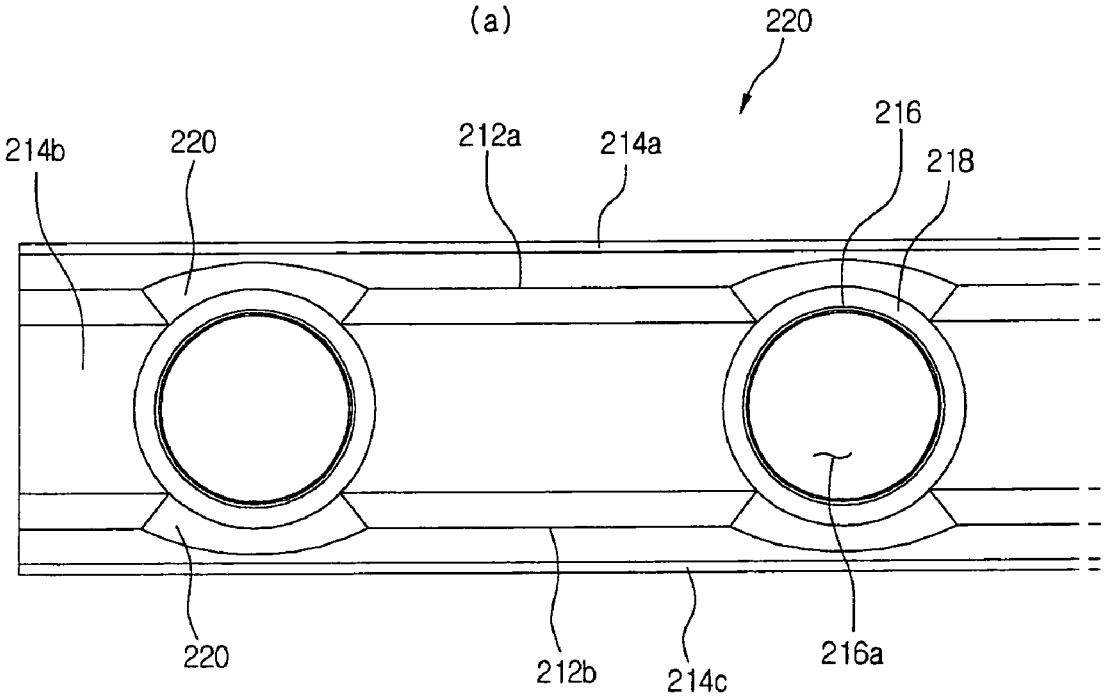
FIG. 15(*a*) is a front view of a fin depicted in FIG. 13.
Figure 15:
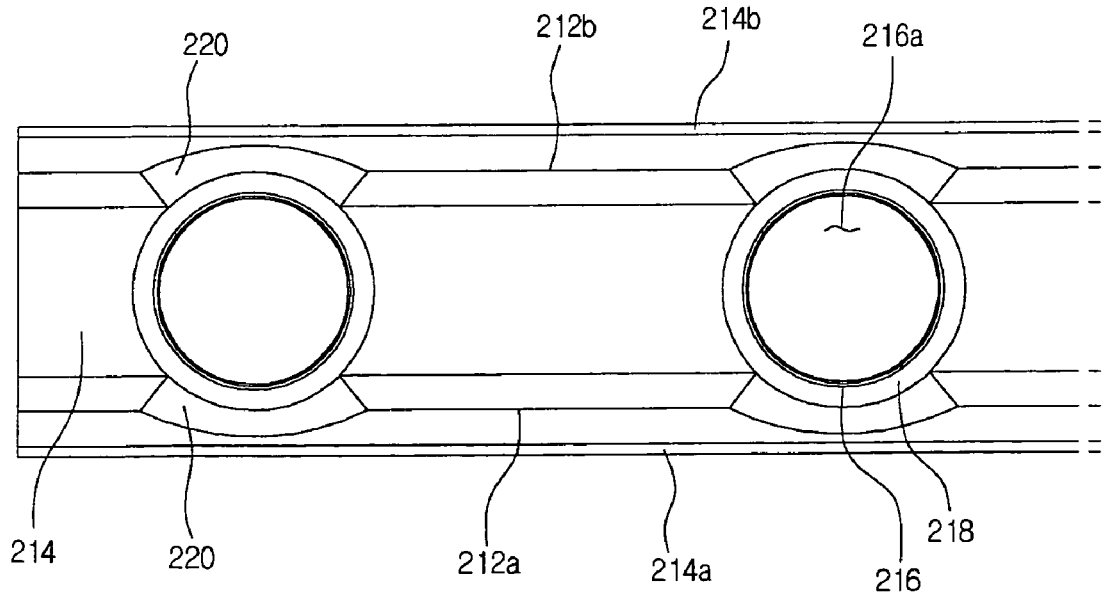

Describing more in detail with reference to FIG. 14, the peak portions 212 and the valleys 214 are alternately disposed. Heights H21 from the horizontal plane to the peak portions 121 are identical to each other.

The second valley portion 214*b* is formed on a longitudinal center portion of the fin between the first and second peak lines 214*a* and 214*b*. The second valley portion 214*b* is flat with the predetermined width W. The width is less than an outer diameter of the tube 230 but greater than an inner diameter of the tube. The tube 230 is disposed such that central axes of the tube 230 perpendicularly penetrate a longitudinal centerline of the second valley portion 214*b*.

As the flat-shaped valley portion 214*b* is formed between the peak portions 212*a* and 212*b*, a distance between the adjacent fins is increased, thereby increasing the air passage area.

Furthermore, the air passing through between the adjacent tubes 230 can be effectively guided up to the rear end of the tube 230. In addition, the pressure drop is reduced against the fast airflow speed and an amount of the heat transfer is increased.

Fin collars 216 defining tube insertion holes in which the tube 230 is inserted are formed on and elevated from the second valley portions 214*b* to support the tube 230.

Seats 218 are formed around a lower end of an outer circumference of the fin collar 216 to allow the air to flow in the form of enclosing the tube 30 and the fin collar 16. Inclined portions 220 are formed on the fin 20 around the seats 218 to prevent the air flowing around the tubes 230 from getting out of a circumference of the tube 230. The inclined portions 220 are inclined upward from the seat 218 to the peak portions 212*a* and 212*b*.

The seats 218 function as a passage communicating the second valley portion 214*b* disposed on a longitudinal direction.

Preferably, the width W of the second valley portion 214 is set as a value that can maximize the frost forming retardation effect under a frost forming condition while minimizing the deterioration of the heat transfer efficiency. For example, when the outer diameter of the fin collar 216 is Wo and the width of the second valley portion 214 is W, it is preferable that the following condition is satisfied.

$$1.0>W/Wo>0.3.$$

Figure 16:
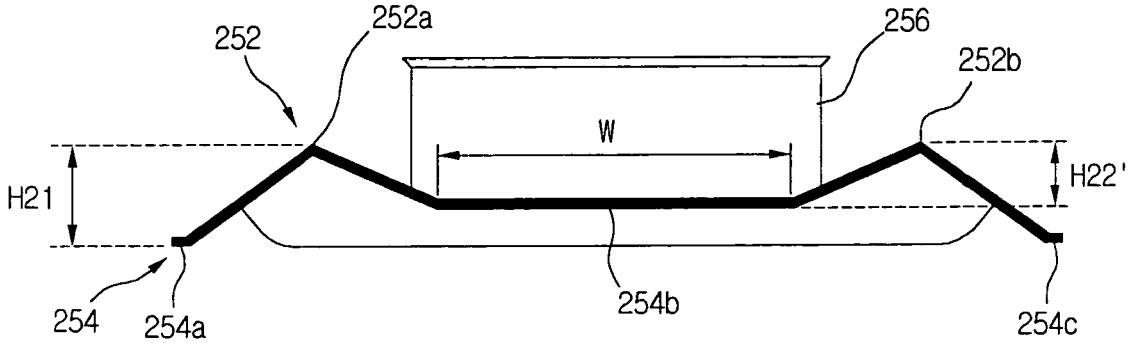
FIG. 16 is a sectional view of a modified example similar to that depicted in FIG. 14.

FIG. 16 shows a modified example of the second embodiment.

In this modified example, a depth H22' of a flat-shaped second valley portion 254 formed between first and second peak portions 252*a* and 252*b* is lower than depths H21' of first and second valley portions 254*a* and 254*c*.

In case the heights H21 of the peak portions 252*a* and 252*b* is higher than the depth of the second valley portion 254*b*, the depth H22' of the second valley portion 254 is lower than the heights of the peak portions 252*a* and 252*b* and higher than the depths of the first and third valley portions 254*a* and 254*c*. The depths of the first and third valley portions 254*a* and 254*c* are identical to each other.

Figure 17:
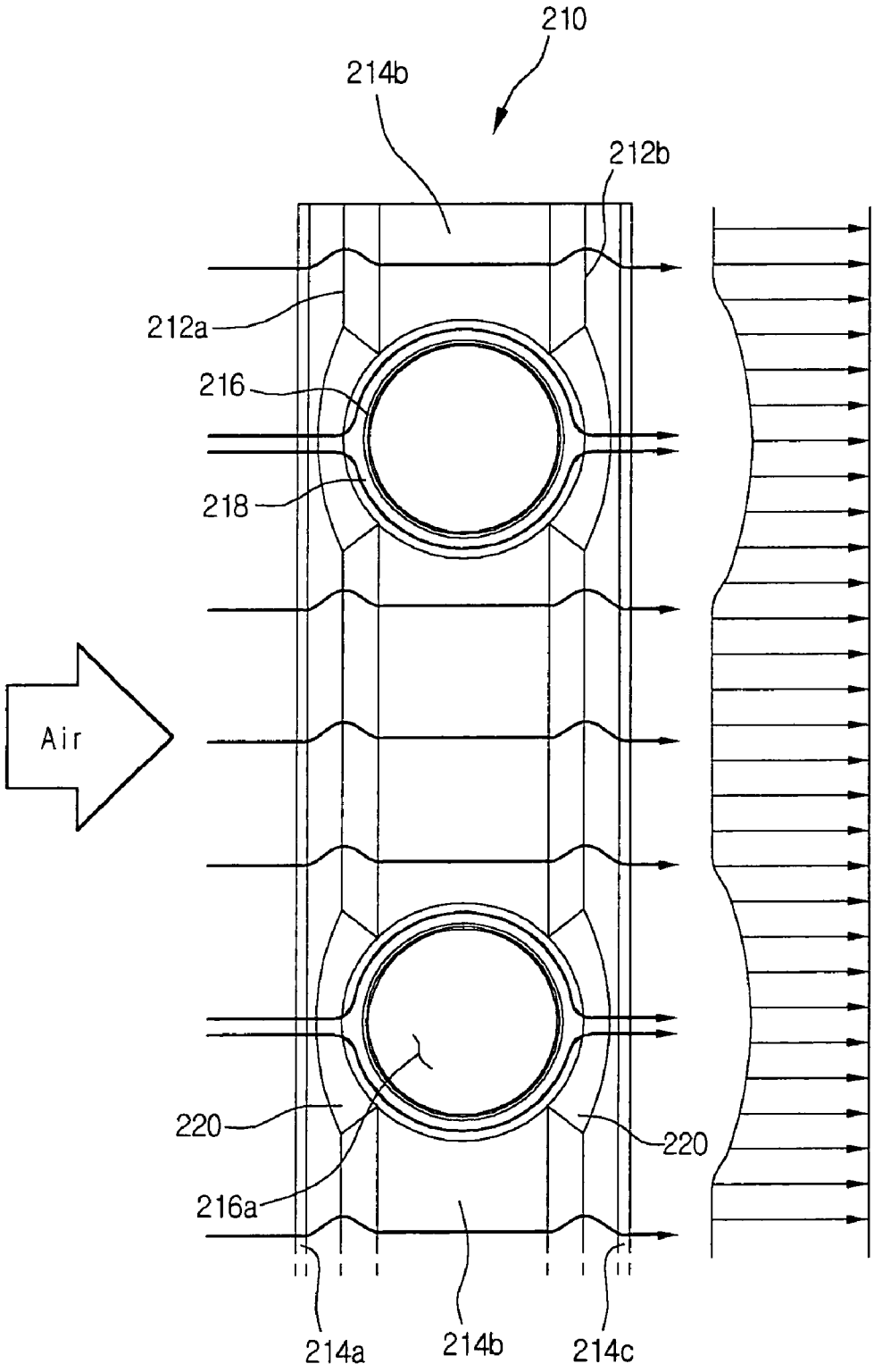
FIGS. 17 and 18 are views illustrating airflow states in a heat exchanger according to a second embodiment of the present invention.
Figure 18:
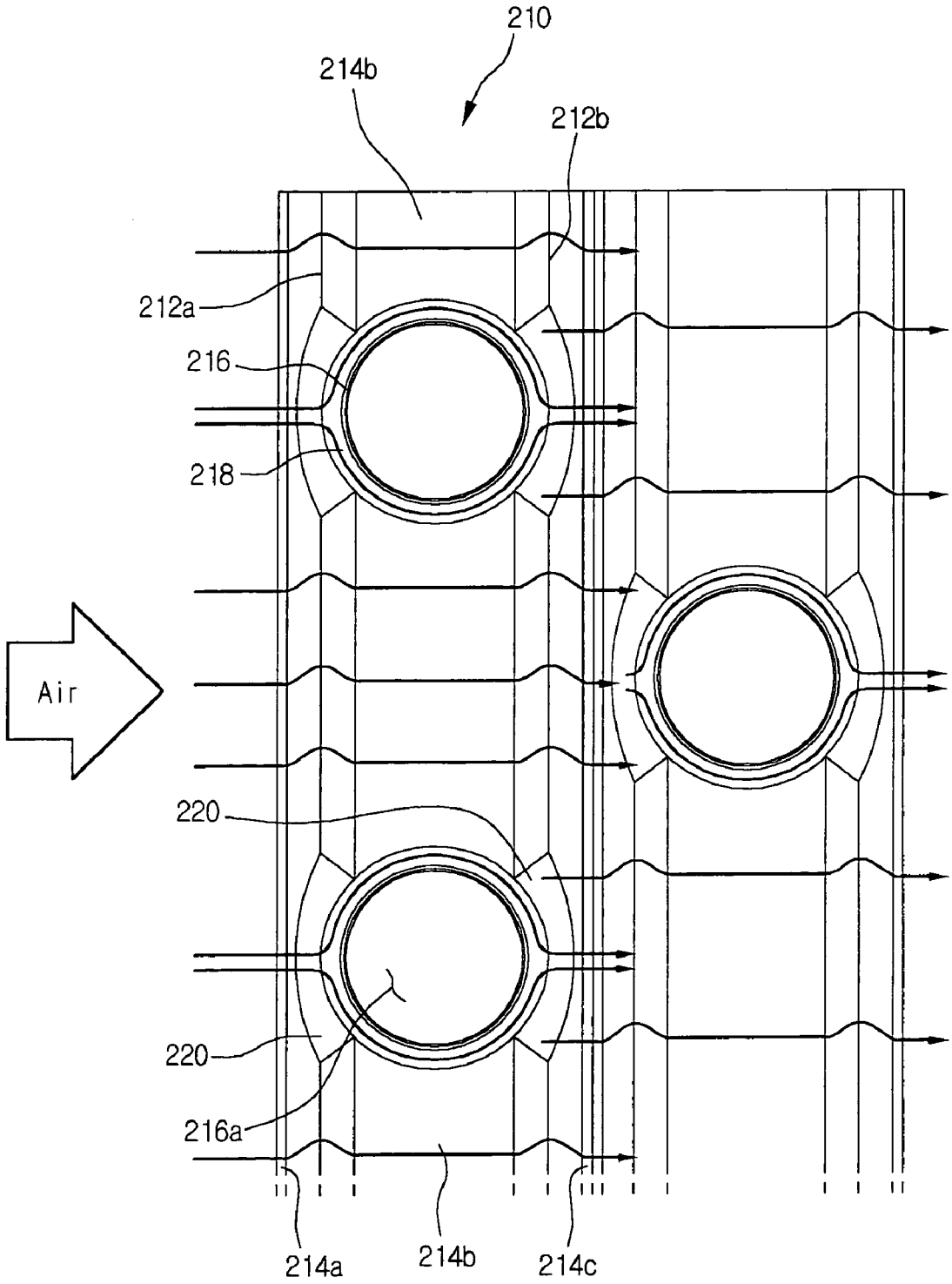

FIGS. 17 and 18 show an airflow state of the heat exchanger according to the second embodiment.

Referring to FIG. 17, air comes in through the first valley portion 214*a* and goes out through the third valley portion 214*c*.

When the air comes in, the air flows around the tube 230 with the increased speed between a narrow gap between the tubes 230. However, the pressure of the air is dropped and the flow resistance is increased.

At this point, the distance between the adjacent fins 210 is increased by the flat-shaped second valley portion 214 formed between the first and second peak portions 212*a* and 212*b* to thereby increase the air passage area. When the air passage area is increased, the pressure drop is reduced while the air still flows with the high speed. That is, the heat transfer is reduced in a high-speed airflow area when compared with a case where the flat-shaped valley portion is not formed. This results in retarding the growth of the frost layer. Accordingly, a high heat capacity can be maintained under the frost forming condition and the heat exchange capacity is increased, thereby making it possible to run the heat exchanger for many hours.

In addition, when the frost is molten, the molten liquid flows toward the flat-shaped valley portion between the tubes, which is then dropt to a lower end of the heat exchanger, thereby improving the drain efficiency of the molten liquid.

FIG. 18 shows an airflow state when the fins are formed in a dual fin structure.

As another modified example, it is possible to combine the first and second embodiments. That is, four peak portions and five valley portions are formed, and the center valley portion is formed in a flat-shape.

As still another modified example, the fins of the first and second embodiments are alternately disposed.

As still yet another modified example, when the fin is formed on a dual fin structure, the first and second embodiments can be respectively applied to left and right portions of the dual fin structure.

THIRD EMBODIMENT

FIGS. 19 to 25 show a third embodiment of the present invention.

Figure 19:
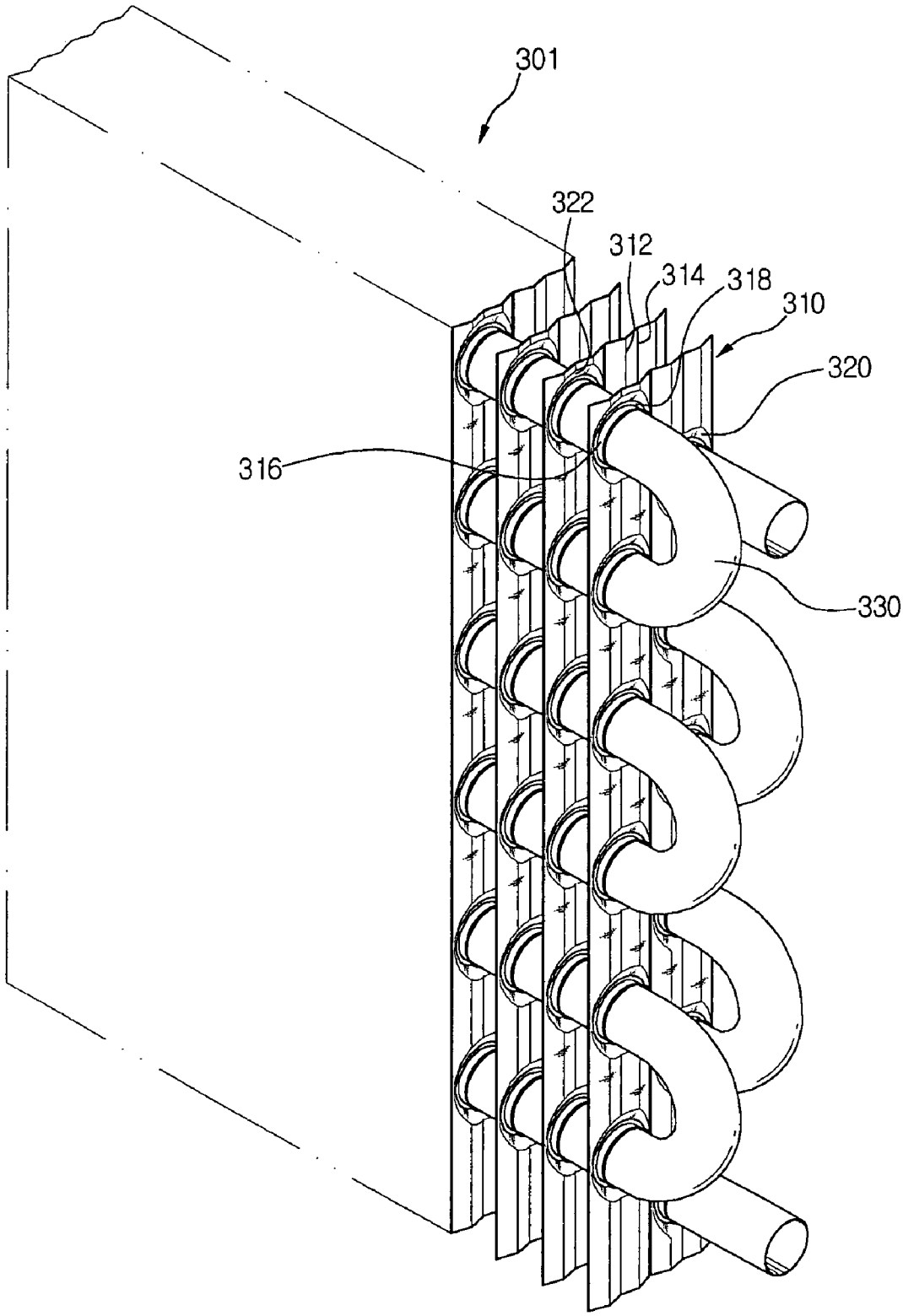
FIG. 19 is a perspective view of a heat exchange according to a third embodiment of the present invention.
Figure 20:
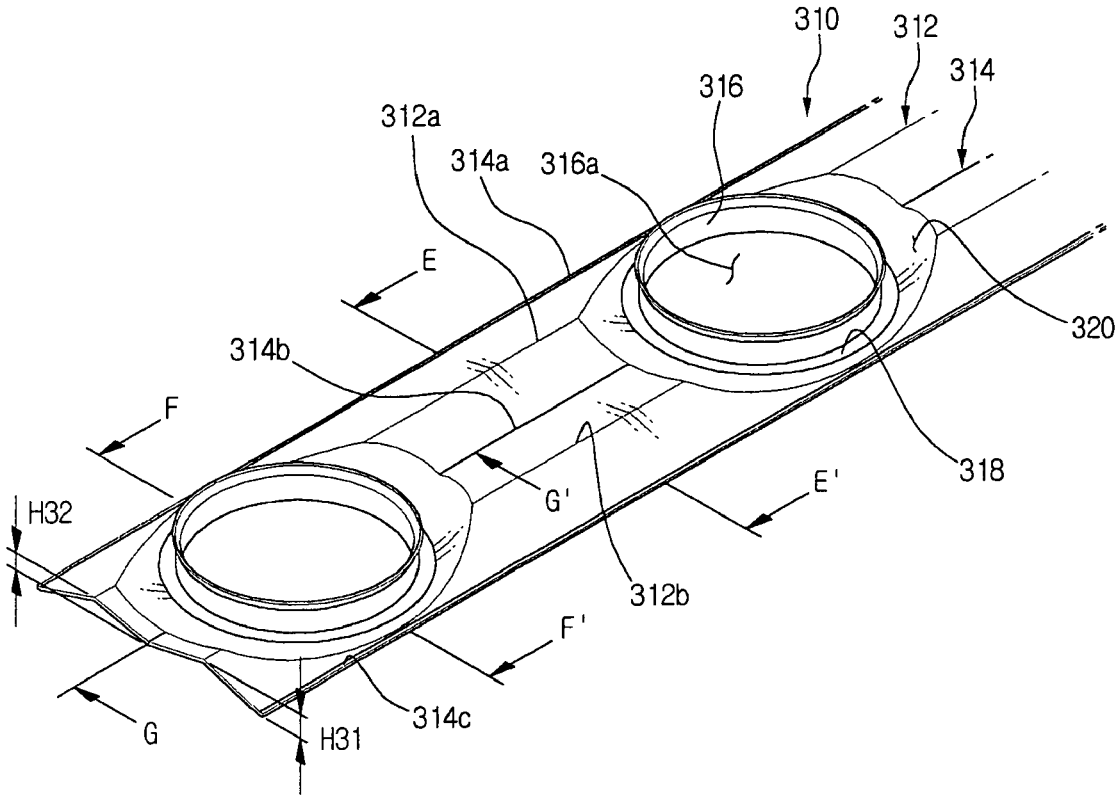
FIG. 20 is a perspective view of a fin depicted in FIG. 19.
Figure 21:
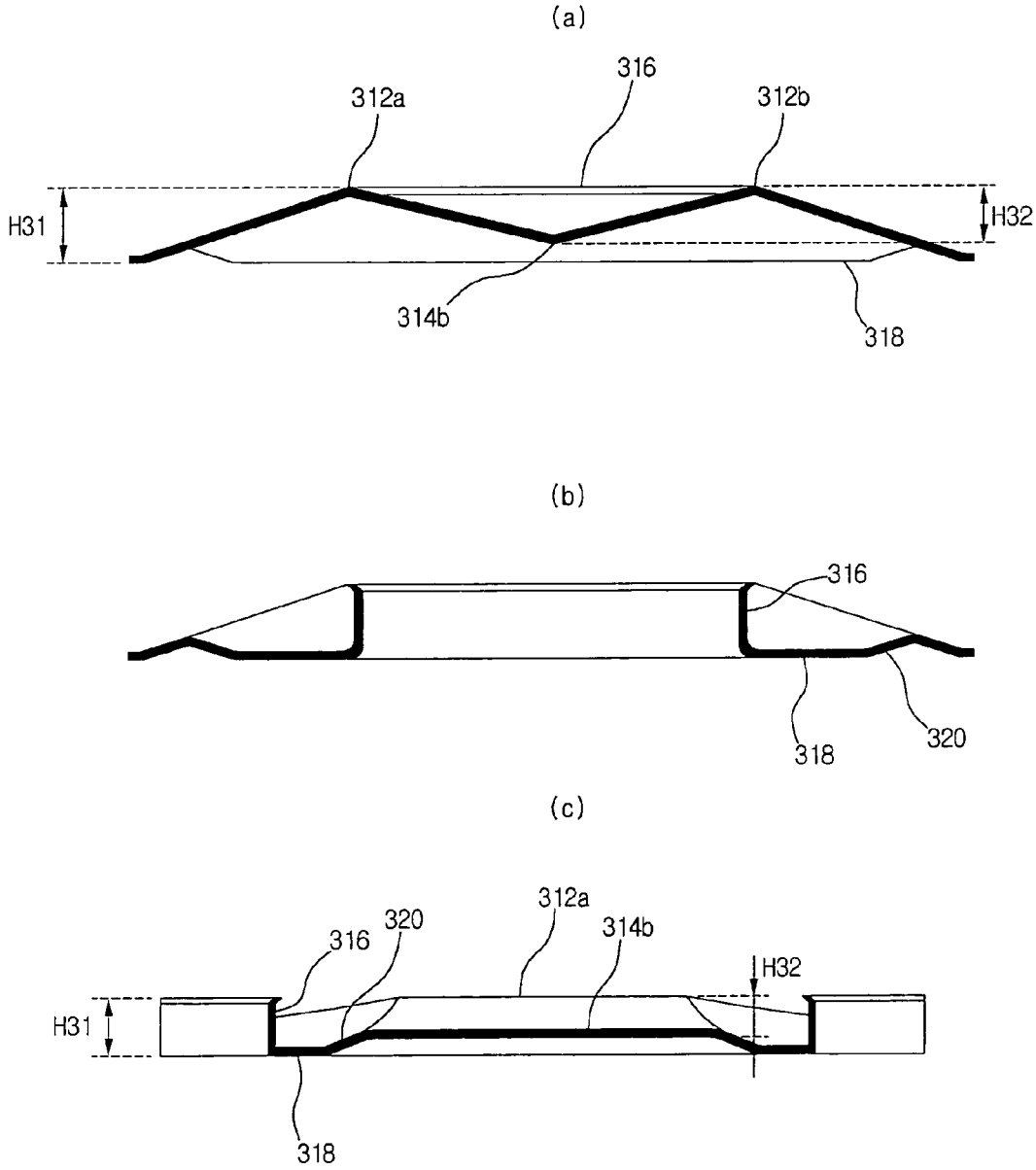
FIG. 21(*a*) is a sectional view taken along the line E-E' of FIG. 20.

Referring to FIGS. 19 to 21, a heat exchanger 301 includes: a plurality of fins 310 each having at least two peak portions 312 and at least two valley portion 114 that are alternately disposed; a plurality of tubes 330 disposed penetrating the fins 310 at right angles; fin collars 316 for fixing the tubes 330 inserted through the fins 310; seats 318 each formed around a lower end of an outer circumference of each fin collar 316; and inclined portions 320 inclined upwardly from outer circumferences to the peak portions 312 to prevent air flowing around the tubes 330 from getting away from a circumference of the tubes 330.

The fin 310 is formed in a W-shape to define the three valley portions 314 (314*a*, 314*b* and 314*c*) and the two peak portions 312 (312*a* and 312*b*) that are respectively formed between the valley portions 314*a* and 314*b* and between the 414*b* and 341*c*. The peak portions 312*a* and 312*b* are located on an identical horizontal plane. A depth H32 from the horizontal plane to the center (second) valley portion 114*b* is lower than those H31 from the horizontal plane to the fist and third valley portions 114*a* and 114*c*.

In addition, heights of the peak portions 312*a* and 312*b* are almost identical to a height of a top of the fin collar 316 defining a tube insertion hole 316*a* through which the tube is inserted.

The inclined portions 320 are formed extending from an outer circumference of the seat 318 formed around the lower end of the outer circumference of the fin collar 316 to the peak portions 312, thereby preventing the air flowing around the tube 330 from getting out of the circumference of the tube 330.

That is, since the seats 318 are located on a horizontal plane identical to that where the first and second valley portions are located, the seats 318 are connected to the peak portions 312 at a predetermined curvature angle from the valley portions to the peak portions in a lateral direction and from the peak portion to the peak portion in a longitudinal direction.

Here, the depth H32 of the second valley portion 314*b* is lower than the depth H31 of the peak portion 312. The ratio of the depth H32 to the depth H31 (H32/H31) should be equal to or lower than 0.7 to reduce the pressure drop against the fast flow speed of the air. Alternatively, the depth H32 of the second valley portion 314*b* can be designed to be greater or less than the heights H31 of the peaks 312.

In order to design the depth H32 of the second valley portion 314*b* to be less than the heights H32 of the peak portions 312, inclined angles of the both side surfaces of the peak portions 312 are designed to be different from each other. That is, the inclined angles of outer sides of the peak portions 312 are greater than those of inner sides of the peak portions 312, which are connected to the second valley portion 314*b*, inside angles of the peak portions 312 become naturally smaller than the inner angle of the second valley 314*b*.

As described above, when the heights H31 of the peak portions 312 is greater than the depth of the second valley portion 314*b*, the second valley is located on a horizontal plane between the horizontal plane where the peak portions 312 are located and the horizontal plane where the seat is located.

Figure 22:
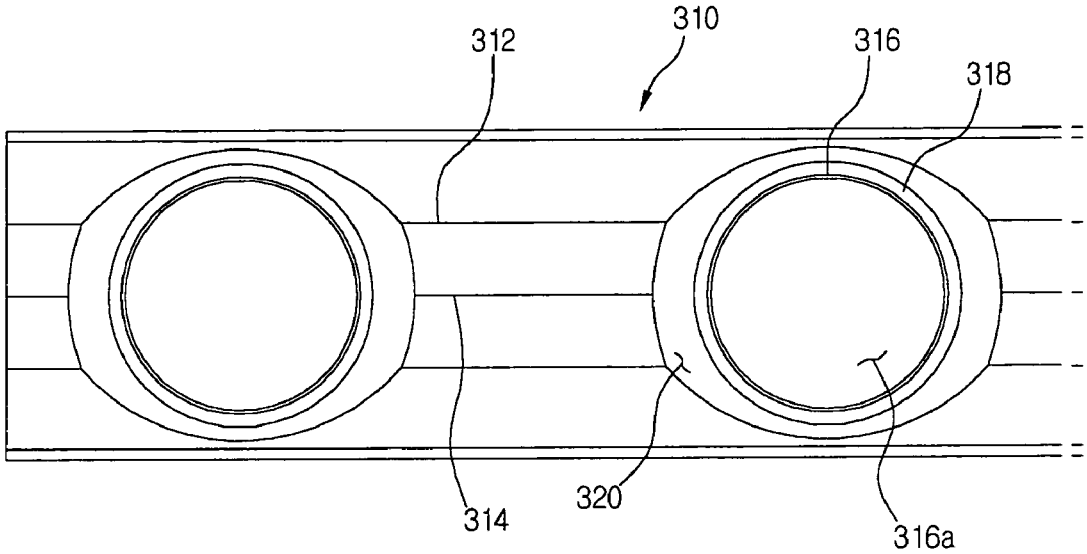
FIG. 22(*a*) is a front view of a fin depicted in FIG. 20.
Figure 22:
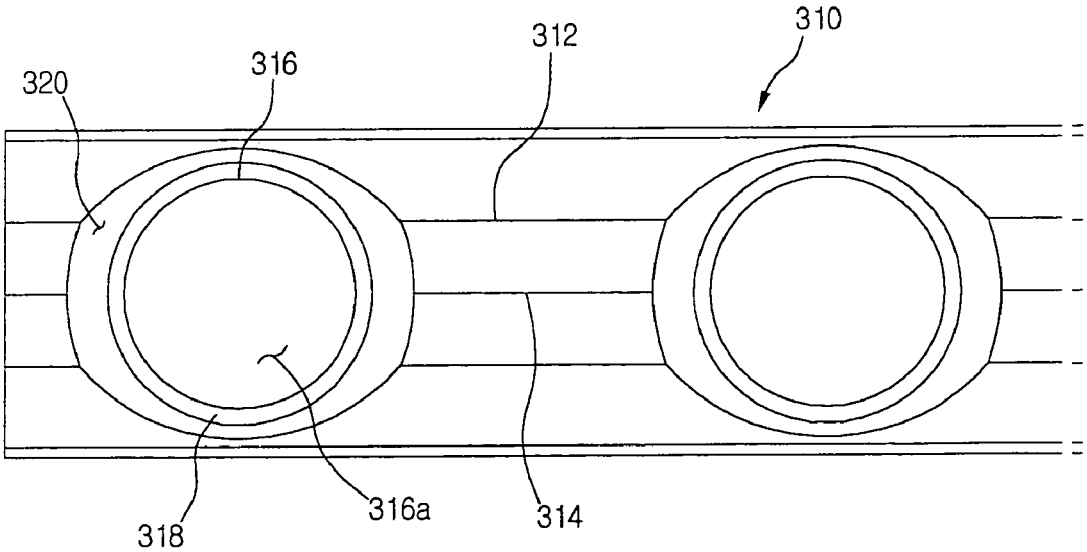

FIGS. 22(*a*) and 22(*b*) respectively show front and rear views of the fin depicted in FIG. 20.

Figure 23:
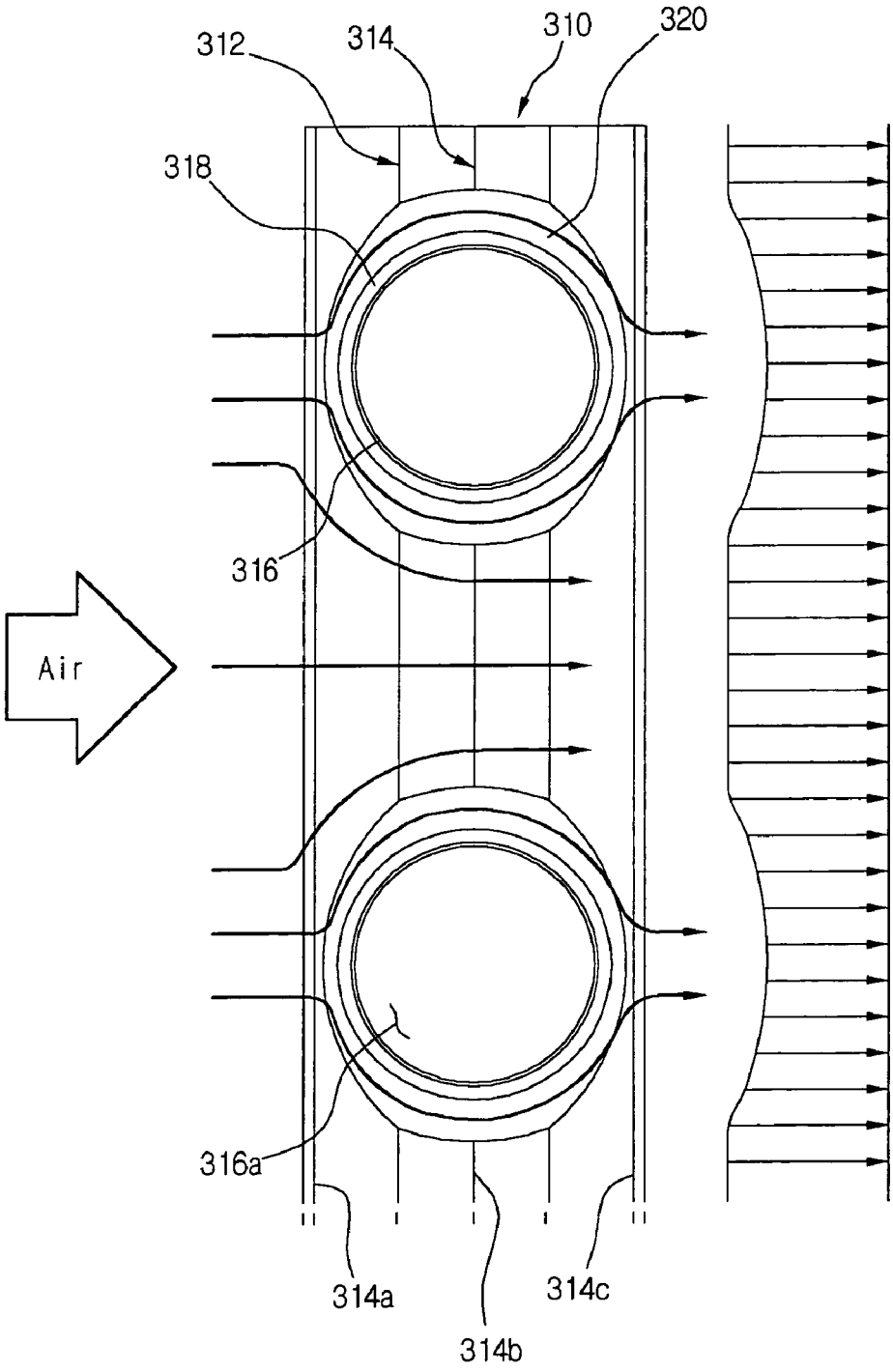
FIGS. 23 and 24 are views illustrating airflow states in a heat exchanger according to a third embodiment of the present invention.
Figure 24:
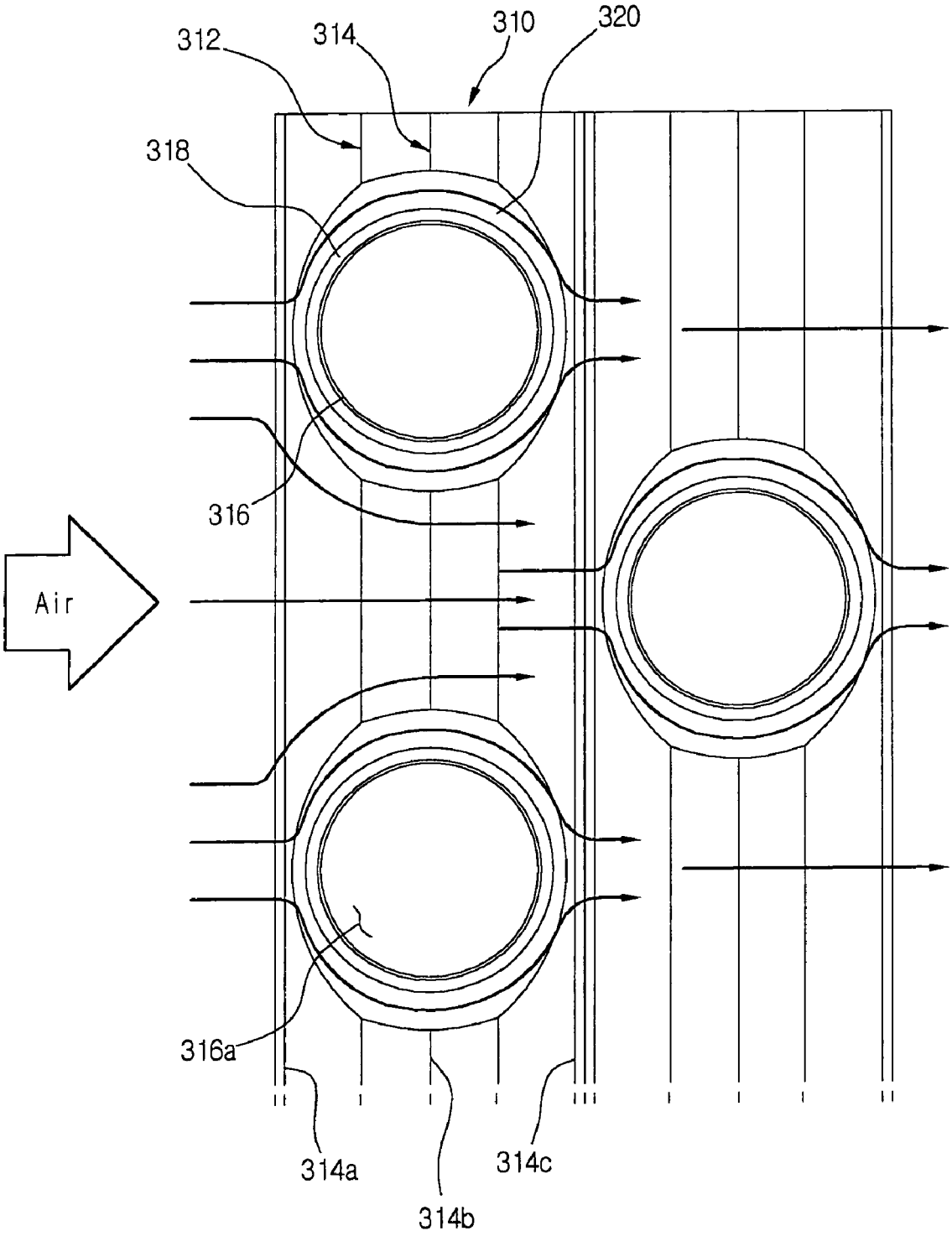

FIGS. 23 and 24 show an airflow state of the heat exchanger according to the third embodiment.

Referring to FIG. 23, when air comes into the heat exchanger, the flow speed of the air is increased between the tubes. However, because of the seats 318 and the height and depth difference between the peak and valley portions, the air resistance is reduced while the air can be guided to the rear end of the tube 330 along the inclined portions 320 and the seats 318.

Figure 25:
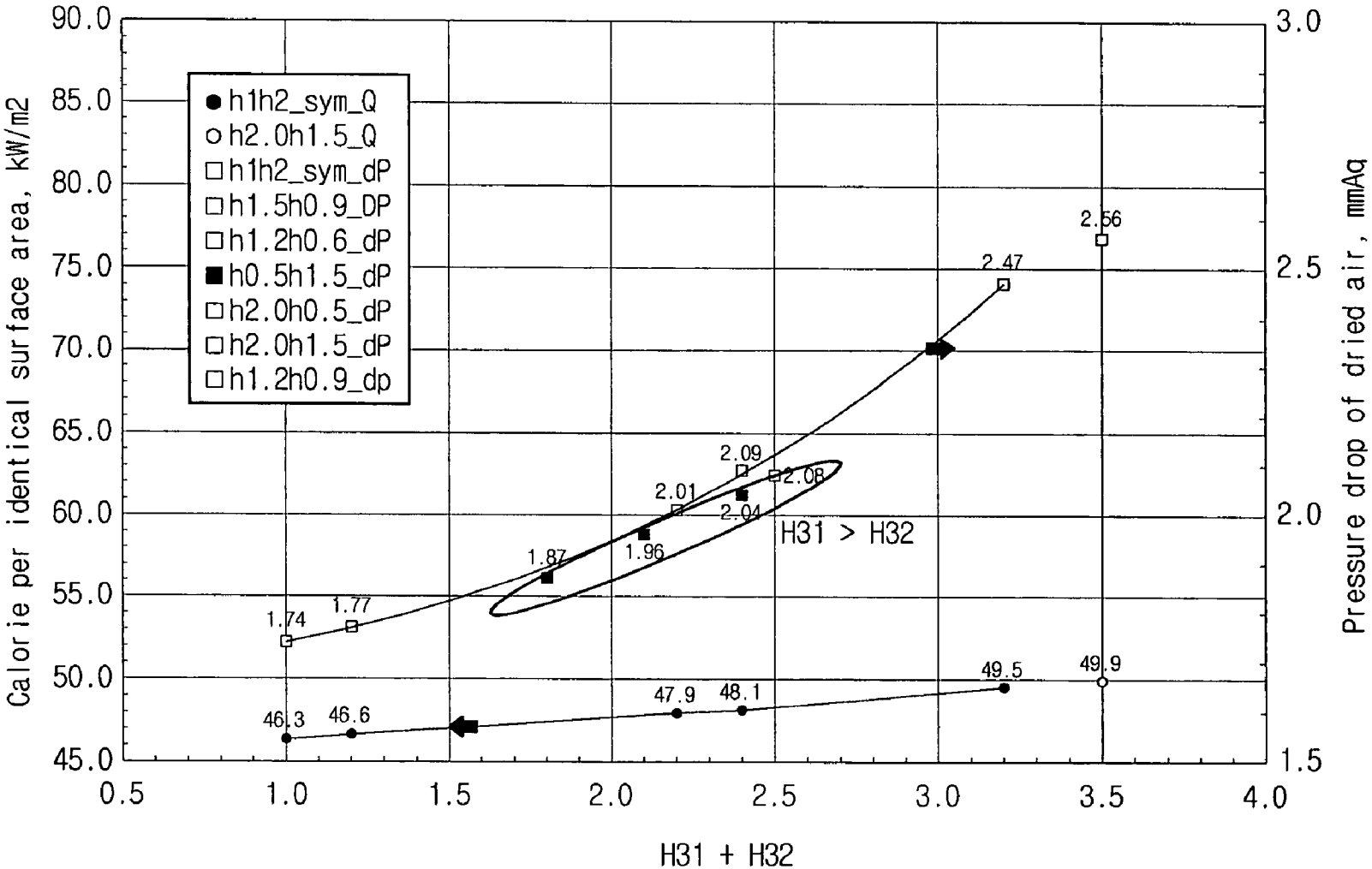
FIG. 25 is a graph illustrating a pressure drop and a heat capacity of a heat exchanger according to the present invention.

FIG. 25 shows a graph illustrating a pressure drop and a heat capacity of a heat exchanger according to the present invention.

As shown in FIG. 25, since the heights of the peak portions 312 are greater than the depth of the valley portion 314*b*, a distance between the adjacent fins 310 is increased. As a result, the pressure drop of the air is reduced against the fast flow speed of the air. Furthermore, since a relatively high heat capacity can be maintained even under a frost forming condition, the heat exchanger can be operated for many hours.

As described in the above embodiments, the pressure drop can be reduced by forming the depth of the valley portion higher than the height of the peak portion, thereby improving the heat exchange efficiency. Further, the airflow around the tubes can be effectively guided to the rear portions of the tubes by installing the inclined portion in the inclined surface between the valley portion and the fin collar.

As described above, the airflow areas between the front and rear fins are increased by forming the peak and valley portions which are inclined and have different heights, thereby reducing the pressure drop. Additionally, an amount of the heat transfer amount is increased to thereby improve the overall efficiency of the heat exchanger.

Further, the pressure drop is decreased due to the change in the air flow by forming the flat-shaped valley portion having the predetermined width (area) between the peak portions. As a result, an amount of the heat transfer is increased and the overall efficiency of the heat exchanger is improved.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A heat exchanger comprising:

a plurality of tubes through which refrigerants flow, the tubes being spaced away from each other; and a plurality of fins spaced away from each other at a predetermined distance, each of the fin including:

a plurality of fin collars through which the tubes are perpendicularly inserted, and a plurality of peak and valley portions alternately disposed in a first direction at an area defined between the tubes, the peak portions and the valley portions extending along a second direction, the peak portions being non-coplanar and the valley portions being substantially coplanar, an interior angle of each of two immediately adjacent peak portions centermost to the corresponding one of the fin collars being different from an interior angle of each of the other peak portions immediately adjacent to the two immediately adjacent peak portions centermost to the corresponding one of the fin collars.

2. The heat exchanger according to claim 1, further comprising a seat disposed around an outer circumference of the corresponding one of the fin collars;

an airflow guide portion formed extending from an outer circumference of the seat to the peak portions at a predetermined angle to prevent air from getting out of a circumference of a corresponding one of the tubes.

3. The heat exchanger according to claim 1, wherein the two immediately adjacent peak portions centermost to the corresponding one of the fin collars extend along the first direction within the area defined between the tubes in the first direction.

4. A heat exchanger comprising:

a plurality of tubes through which refrigerants flow, the tubes being spaced away from each other; and a plurality of fins spaced away from each other at a predetermined distance, each of the fins including:

a plurality of fin collars through which tube is perpendicularly inserted, a plurality of seats, each of the seats being disposed around an outer circumference of a corresponding one of the fin collars, a plurality of peak and valley portions alternately disposed in a first direction at an area defined between the tubes, the peak portions and the valley portions extending along a second direction, one of the valley portions being located between two immediately adjacent peak portions centermost to the corresponding one of the fin collars, and a plurality of inclined portions extending from an outer circumference of a corresponding one of the seats to at least two of the peak portions, each of the two of the peak portions being respectively immediately adjacent to the two immediately adjacent peak portions centermost to the corresponding one of the fin collars.

5. The heat exchanger according to claim 4, wherein the seat and the valley portions are coplanar.

6. The heat exchanger according to claim 4, wherein the inclined portion extending from an outer circumference of the corresponding one of the seats to one of the two of the peak portions is symmetrical to the inclined portion extending from the outer circumference of the corresponding one of the seats to the other one of the two of the peak portions with respect to the one of the valley portions.

7. A heat exchanger comprising:

a plurality of tubes through which refrigerants flow, the tubes being spaced away from each other; and a plurality of fins, each of the fins including:

a plurality of fin collars through which the tubes are perpendicularly inserted; and a plurality of peak and valley portions that are alternately disposed in a first direction at an area defined between the tubes, the peak portions and the valley portions extending along a second direction, two immediately adjacent peak portions centermost to a corresponding one of the fin collars being substantially coplanar and having a height different from the other peak portions immediately adjacent to the two immediately adjacent peak portions centermost to the corresponding one of the fin collars.

8. The heat exchanger according to claim 7, wherein the adjacent tubes are inserted into the fin collars in a zigzag shape.

9. The heat exchanger according to claim 7, wherein a ratio of the depths of the valley portions to the heights of the peak portions is equal to or less than 0.7.

10. The heat exchanger according to claim 7, wherein each of the fins is a corrugate fin having an inversed W-shape.

11. The heat exchanger according to claim 7, wherein an interior angle of each of the two immediately adjacent peak portions centermost to the corresponding one of the fin collars is different from an interior angle of each of the other peak portions immediately adjacent to the two immediately adjacent peak portions centermost to the corresponding one of the fin collars.

12. The heat exchanger according to claim 7, wherein the valley portions are substantially coplanar.

13. The heat exchanger according to claim 12, wherein the height of the two immediately adjacent peak portions centermost to the corresponding one of the fin collars is lower than the other peak portions immediately adjacent to the two immediately adjacent peak portions centermost to the corresponding one of the fin collars.

14. The heat exchanger according to claim 7, wherein each of the fins is symmetrical with respect to one of the valley portions between the two immediately adjacent peak portions centermost to the corresponding one of the fin collars.

15. The heat exchanger according to claim 7, wherein each of the fins further comprises:

a plurality of seats each disposed on a lower end of an outer circumference of the fin collars; and an airflow guide portion formed extending from an outer circumference of each of the seats to the peak portions at a predetermined angle to allow air to flow along an outer circumference of the tubes.

16. The heat exchanger according claim 15, wherein the seats are substantially coplanar to the valley portions.

17. The heat exchanger according to claim 7, wherein the two immediately adjacent peak portions centermost to the corresponding one of the fin collars extend along the first direction within the area defined between the tubes in the first direction.

* * * * *